US006907222B2

(12) United States Patent
Lee et al.

(10) Patent No.: US 6,907,222 B2
(45) Date of Patent: Jun. 14, 2005

(54) METHOD AND APPARATUS OF CONTROLLING AN IMAGE INPUT AND A RECORDING-MEDIUM SUPPLY OF AN IMAGE FORMING APPARATUS

(75) Inventors: Beom-ro Lee, Gyeonggi-do (KR); Cheol-ju Yang, Daegu Metropolitan (KR); Jun-bae Jeon, Seoul (KR)

(73) Assignee: Samsung Electronics Co., LTD, Suwon-Si (KR)

( * ) Notice: Subject to any disclaimer, the term of this patent is extended or adjusted under 35 U.S.C. 154(b) by 0 days.

(21) Appl. No.: 10/677,530

(22) Filed: Oct. 3, 2003

(65) Prior Publication Data

US 2004/0120743 A1 Jun. 24, 2004

(30) Foreign Application Priority Data

Nov. 22, 2002 (KR) ..... 10-2002-0073041

(51) Int. Cl.[7] ..... G03G 15/00

(52) U.S. Cl. ..... 399/394; 399/301; 358/1.6

(58) Field of Search ..... 399/301, 302, 399/381, 388, 394, 396; 347/139, 234; 355/401, 407; 271/264; 358/1.5, 1.6

(56) References Cited

U.S. PATENT DOCUMENTS

| | | | | | |
|---|---|---|---|---|---|
| 4,416,534 | A | * | 11/1983 | Kluger | 399/396 |
| 4,519,700 | A | * | 5/1985 | Barker et al. | 399/394 |
| 4,526,461 | A | * | 7/1985 | Eertink | 399/396 |
| 5,731,680 | A | * | 3/1998 | Winterberger et al. | 318/685 |
| 6,370,354 | B1 | * | 4/2002 | Chapman et al. | 399/394 |
| 6,633,740 | B2 | * | 10/2003 | Estabrooks | 399/384 |
| 6,694,110 | B2 | * | 2/2004 | Akashi et al. | 399/50 |
| 6,788,322 | B2 | * | 9/2004 | Morita | 347/139 |

* cited by examiner

*Primary Examiner*—Ren Yan
(74) *Attorney, Agent, or Firm*—Staas & Halsey LLP

(57) ABSTRACT

A method and apparatus to control an image input and a recording-medium supply of an image forming apparatus. An aspect of the method comprises periodically generating synchronized demand of an image input into the exposure unit and supplying of a recording medium to the transfer unit, and inputting an image into the exposure unit according to the synchronized demand on image input and supplying a recording medium to the transfer unit according to the synchronized demand on recording-medium supply.

56 Claims, 13 Drawing Sheets

METHOD AND APPARATUS OF CONTROLLING AN IMAGE INPUT AND A RECORDING-MEDIUM SUPPLY OF AN IMAGE FORMING APPARATUS

CROSS-REFERENCE TO RELATED APPLICATIONS

This application claims the priority of Korean Patent Application No. 2002-73041, filed on Nov. 22, 2002, in the Korean Industrial Property Office, the disclosure of which is incorporated herein in its entirety by reference.

BACKGROUND OF THE INVENTION

1. Field of the Invention

An aspect of the present invention relates to inputting an image into an exposure unit and supplying a recording medium to a transfer unit in an image forming apparatus such as a printer, a copier, and a facsimile, and more particularly, to a method and apparatus to control an image input and a recording-medium supply of an image forming apparatus.

2. Description of the Related Art

An electrophotographic image forming apparatus inputs an image, which is transferred from a host such as a PC, a workstation, or an input from an image input unit such as a copier into an exposure unit such as a laser scanning unit (LSU) or a light emitting diode (LED). The image forming apparatus forms the input image on a photosensitive body such as an electrostatic latent image, and changes the electrostatic latent image into a toner image via a developing unit. Meanwhile, the image forming apparatus accurately moves a recording medium, such as paper, via a recording-medium supply unit and a recording-medium movement adjusting unit, and transfers the above-mentioned toner image on the recording medium, thereby completing a printing operation. In this case, line synchronizing signals or horizontal synchronizing signals, which are line control signals output from the exposure unit, are used to input the image transferred from the host or input from the image input unit into the exposure unit. The line synchronizing signals or the horizontal synchronizing signals are the basis of a starting point per line on a printing image. The image forming apparatus counts the line control signals and controls the start and end of an image input into the exposure unit. Moreover, a timer in the image forming apparatus is used to control a supply time needed for the recording medium to be supplied from the recording-medium supplying unit to the transfer unit. Accordingly, the image input and the recording-medium supply are controlled in different manners. Therefore, in order to print a good-quality image, it is very important to precisely synchronize the time when the image is input into the exposure unit with the time when the recording medium is supplied to the transfer unit. This is particularly required to print a color image because equalizing each color image with each toner image and equalizing the coincident toner image with a recording medium determine printing image quality.

Generally, in order to place an image properly on a recording medium, a monochromatic image forming apparatus synchronizes line control signals outputted from an exposure unit with front end signals of the recording medium supplied from a recording-medium supply unit to control a time when an image is input into the exposure unit. However, since most color image forming apparatuses have a movement path of an image relatively longer than a movement path of the recording medium, the color image forming apparatus synchronizes line control signals with an image input time to control a time when a recording medium is supplied. Moreover, an image input time and a recording-medium supply time are synchronized by a rotation period of a developing unit or a transfer unit.

However, before a printing operation on a first page is completed, a printing operation may be performed on a second page, meaning, a printing operation may be repeatedly and simultaneously performed on two or more pages. This case usually occurs when a path through which the recording medium passes is long. However, even when a toner image of each color is overlapped on another toner image during a color image printing operation, a repeated printing operation may be performed. When the repeated printing operation is performed, if a counter that counts an image input time and a timer that calculates a recording-medium supply time are initialized when each printing operation starts, it cannot be checked whether the recording medium is exhausted from the image forming apparatus after the printing operation is completed. Thus, in order to check whether the recording medium is exhausted from the image forming apparatus, a counter or a timer used for a previous page should not be initialized. Therefore, in order to control the image input time and the recording-medium supply time during the repeated printing operation, a plurality of counters and timers to control the image input and the recording-medium supply should be used. The plurality of counters and timers are synchronized at various points in time. Thus, in order to control the plurality of counters and timers, the image forming apparatus ends up becoming complicated.

SUMMARY OF THE INVENTION

Accordingly, it is an aspect of the present invention to provide a method to control an image input and a recording-medium supply of an image forming apparatus via which demands on an image input and a recording-medium supply are synchronized by periodically generating a timer interrupt such that an image can be printed in a correct position on the recording medium even under a simple control.

Another aspect of the present invention provides an apparatus to control an image input and a recording-medium supply of an image forming apparatus in which the method to control the image input and the recording-medium supply of an image forming apparatus is implemented.

Additional aspects and advantages of the invention will be set forth in part in the description which follows and, in part, will be obvious from the description, or may be learned by practice of the invention.

According to an aspect of the present invention, a method to control an image input and a recording-medium supply of an image forming apparatus is provided. The method comprises: periodically generating synchronized demands of an image input into the exposure unit and for a recording medium supply to the transfer unit, inputting the image into the exposure unit according to the synchronized demand on image input, and supplying the recording medium to the transfer unit according to the synchronized demand on recording-medium supply. The method further comprises: forming an electrostatic latent image via an exposure unit in response to an image input signal, changing the image in which the electrostatic latent image is formed into a toner image via a developing unit, and transferring the toner image on a recording medium to which the toner image is supplied via a transfer unit.

According to another aspect of the present invention, an apparatus to control image input and a recording-medium supply of an image forming apparatus is provided. The apparatus comprises an exposure unit to form an electrostatic latent image in response to an input image signal, a developing unit to change the image in which the electrostatic latent image is formed into a toner image, and a transfer unit to transfer the toner image on a recording medium to which the toner image is supplied. Moreover, the apparatus includes a synchronization signal generating unit which periodically generates each synchronization demand signal to input an image into the exposure unit and to supply a recording medium to the transfer unit, and to output each generated synchronization demand signal, an image input processing unit which inputs an image into the exposure unit in response to the synchronization demand signal for image input, and a recording-medium supply processing unit which supplies a recording medium to the transfer unit in response to the synchronization demand signal for recording-medium supply.

BRIEF DESCRIPTION OF THE DRAWINGS

The above and/or other aspects and advantages of the invention will become apparent and more appreciated from the following description of the embodiments taken in conjunction with the accompanying drawings of which.

DETAILED DESCRIPTION OF THE PREFERRED EMBODIMENTS

Figure 1:
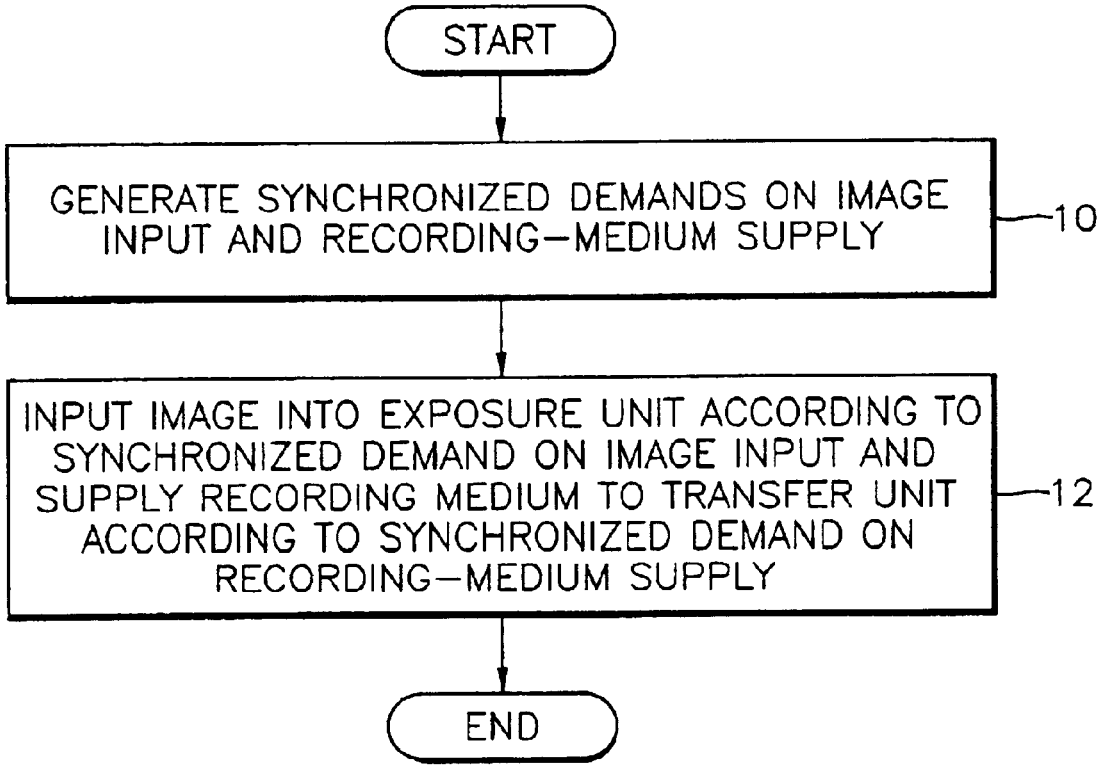
FIG. 1 is a flow chart to illustrate a method to control an image input and a recording-medium supply of an image forming apparatus according to the present invention.

Reference will now be made in detail to the present preferred embodiments of the present invention, examples of which are illustrated in the accompanying drawings, wherein like reference numerals refer to like elements throughout.

A method to control an image input and a recording-medium supply of an image forming apparatus according to one aspect of the present invention is shown in FIG. 1. The method comprises the operations 10 and 12 of inputting an image into an exposure unit and supplying a recording medium to a transfer unit according to demands of an image input and demands for a recording-medium supply, which are periodically generated.

In operation 10 shown in FIG. 1, synchronized demands of an image input into an exposure unit and synchronized demands for a recording medium supply to a transfer unit are periodically generated. The demand on image input and the demand on recording-medium supply are generated at the same point in time. The synchronized demands are periodically generated. A generation period of the synchronized demands may be arbitrarily set, may be coincident with a rotation period of a developing unit in which the input image is changed into a toner image, or a rotation period of the transfer unit in which the toner image is transferred on the supplied recording medium.

Figure 2:
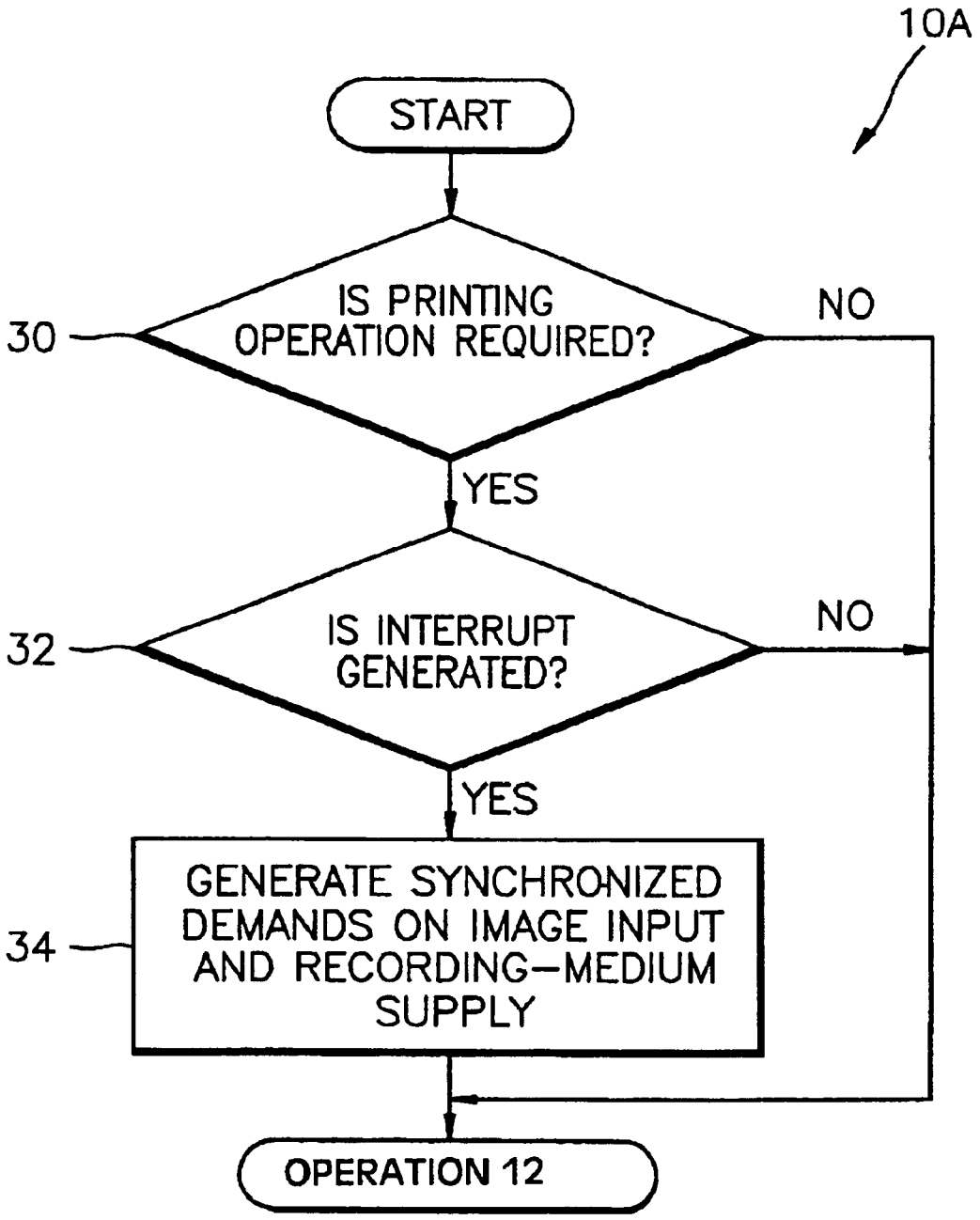
FIG. 2 is a flow chart to illustrate operation 10 shown in FIG. 1.

An embodiment 10A of operation 10 shown in FIG. 1, according to an aspect of the present invention, is shown in FIG. 2. The embodiment 10A comprises operations 30 through 34 of generating synchronized demands of image input and for recording-medium supply via a generated interrupt if a printing operation is required.

In operation 30, it is determined whether a printing operation is required from a host such as a PC, a workstation, or from an image forming apparatus, such as a facsimile or a copier. If it is determined that the printing operation is not required, the embodiment 10A proceeds to operation 12 of FIG. 1.

However, if it is determined that the printing operation is required, in operation 32, it is determined whether an interrupt is generated. If it is determined that the interrupt is not generated, the embodiment 10A proceeds to operation 12 of FIG. 1.

However, if it is determined that the interrupt is generated, in operation 34, each synchronized demand of image input and for recording-medium supply is generated. The synchronized demands of image input and for recording-medium supply are simultaneously generated whenever the interrupt is generated.

After operation 10, in operation 12, the image is input into the exposure unit according to the synchronized demand of the image input, and demand for the recording medium is supplied to the transfer unit according to the synchronized demand on recording-medium supply.

Figure 3:
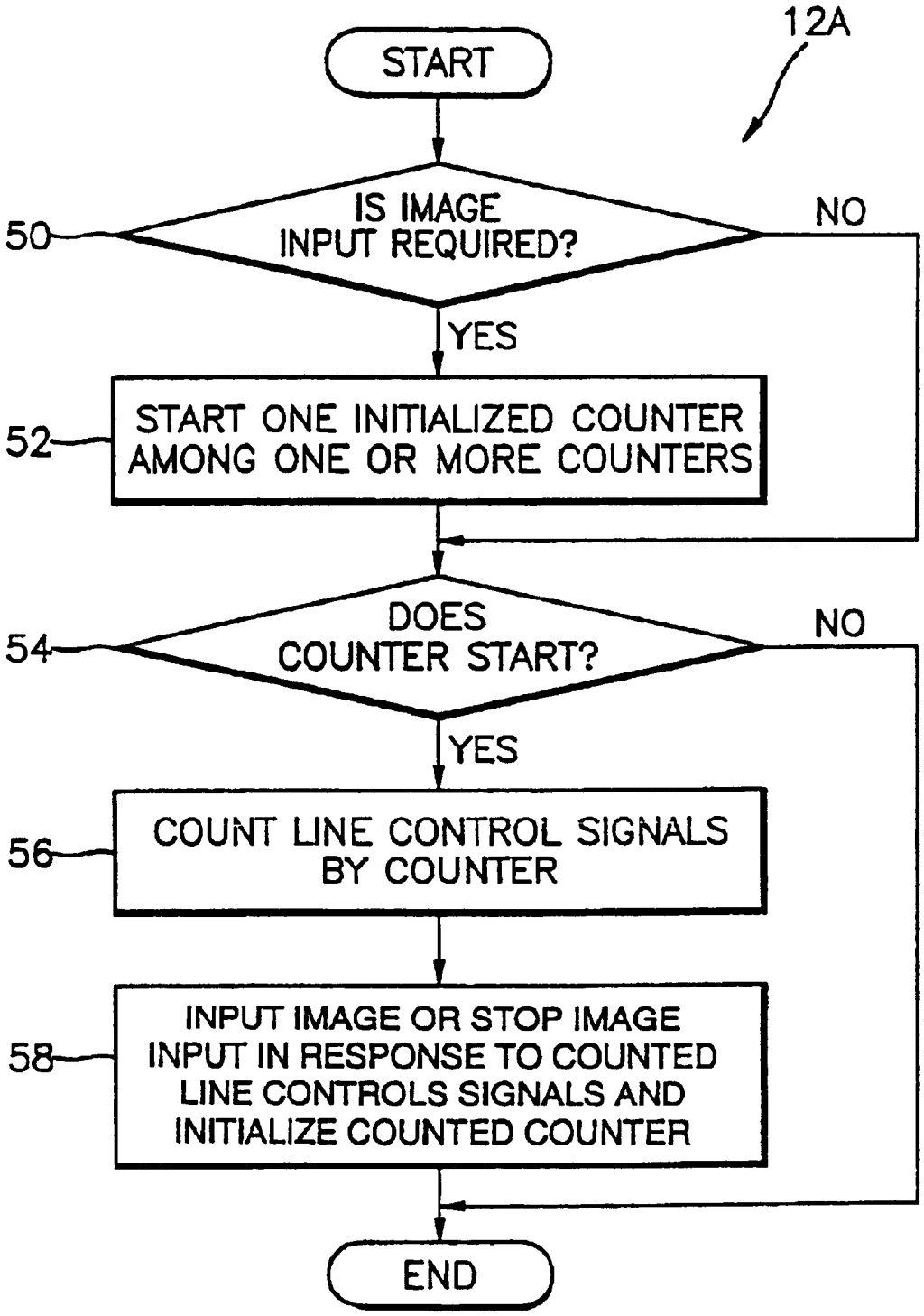
FIG. 3 is a flow chart to illustrate inputting an image into an exposure unit according to demands on synchronization of image input of operation 12 shown in FIG. 1.

An embodiment 12A of inputting an image into an exposure unit according to demands on synchronization of image input of operation 12 shown in FIG. 1 is shown in FIG. 3. The embodiment 12A comprises operations 50 through 58 of counting the number of line control signals, if image input is required, using an initialized counter, starting or stopping image input, and initializing the counter. The line control signals output from the exposure unit are line synchronizing signals or horizontal synchronizing signals, which are the basis of a starting point per line on a printing image. In the embodiment 12A, since the number of line control signals is counted, counting the number of line control signals starts whenever the line control signals are generated.

In operation 50, it is determined whether an image input is required. If the image input is not required, the embodiment 12A proceeds to operation 54.

However, if it is determined that image input is required, in operation 52, an initialized counter found among one or more counters to count the number of line control signals output from the exposure unit starts counting the line control signals. Here, a sufficient number of counters have to be prepared so that an adequate number of counters can be initialized.

After operation 52, in operation 54, it is determined whether there is a counter that starts counting the line control signals. If there is no counter that starts counting the line control signals, after the above-mentioned operations are terminated, the embodiment 12A repeats the above operations at a next line control signal generation time.

However, if it is determined that there is a counter that starts counting the line control signals, in operation 56, the counter counts the line control signals. By counting the line control signals using the counter, the time to input the image into the exposure unit can be determined.

After operation 56, in operation 58, the image is input into the exposure unit or image input stops according to the number of counted line control signals and the counters which counted the line control signals are initialized.

Figure 4:
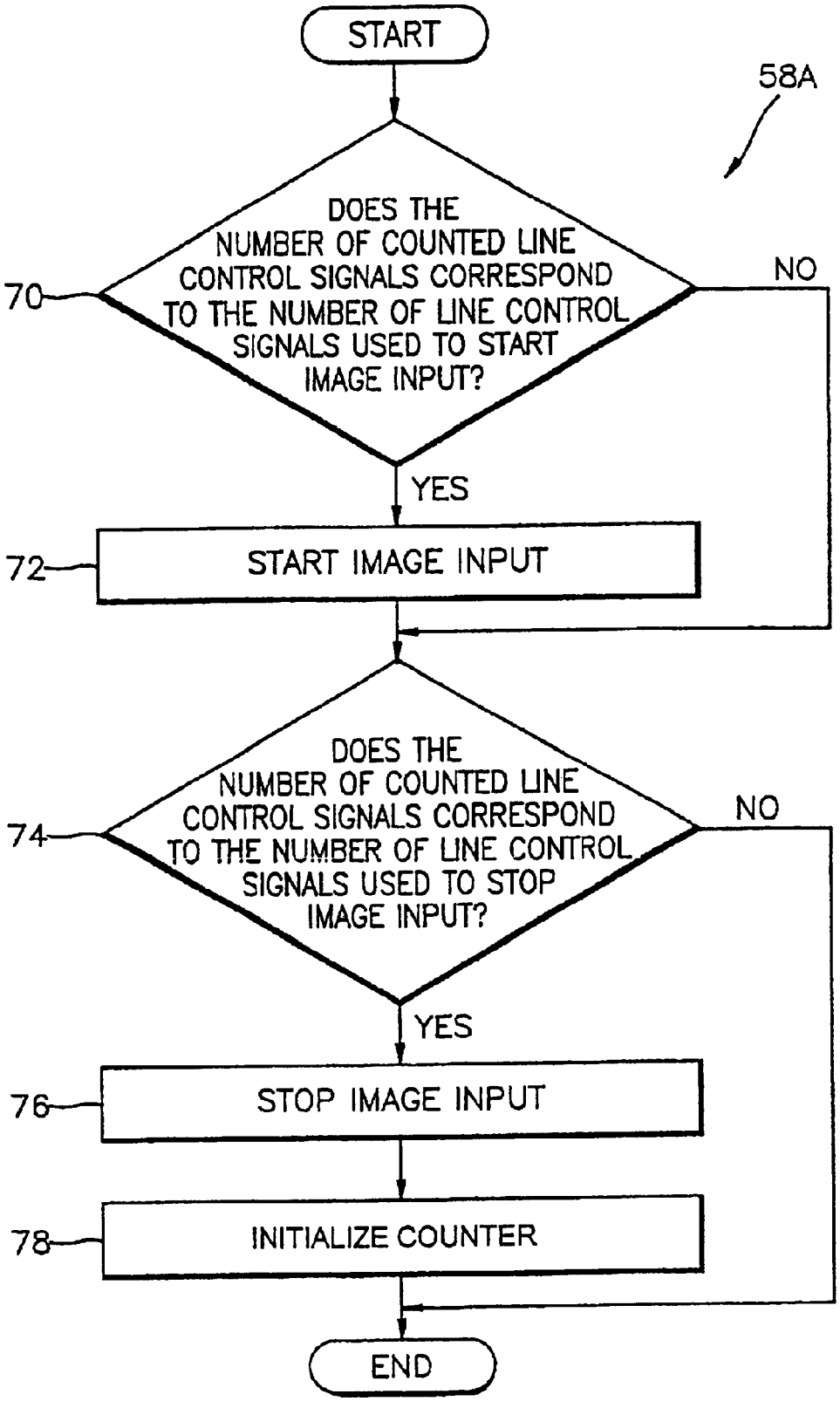
FIG. 4 is a flow chart to illustrate operation 58 shown in FIG. 3.

An embodiment 58A of operation 58 shown in FIG. 3, according to an aspect of the present invention is shown in FIG. 4. The embodiment 58A comprises operations 70 through 78 of starting or stopping image input and initializing counters.

In operation 70, it is determined whether the number of line control signals counted by the counter corresponds to a number of line control signals used to start image input. The number of line control signals used to start image input is defined by whether, for example, an exposure unit employing a laser scanning unit (LSU) starts inputting an image into the exposure unit when a laser beam is scanned a predetermined times. The number is preset before the printing operation is performed. If it is determined that the number of counted line control signals does not correspond to the number of line control signals used to start image input, the embodiment 58A does not proceed to operation 72 but proceeds to operation 74.

However, if it is determined that the number of counted line control signals corresponds to the number of line control signals used to start image input, in operation 72, image input starts. That is, the image is input into the exposure unit.

After operation 72, in operation 74, it is determined whether the number of counted line control signals corresponds to a number of line control signals used to stop an image input. The number of line control signals used to stop image input is, as described previously, defined by whether, for example, an exposure unit employing a laser scanning unit (LSU) stops input of an image into the exposure unit when a laser beam is scanned a predetermined times. The number is preset before the printing operation is performed. If it is determined that the number of counted line control signals does not correspond to the number of line control signals used to stop image input, after the above-mentioned operations are terminated, the embodiment 58A performs the above-mentioned operations again at a next execution point in time.

However, if it is determined that the number of line control signals corresponds to the number of line control signals used to stop image input, in operation 76, image input stops. That is, inputting the image into the exposure unit stops.

After operation 76, in operation 78, counters via which the number of line control signals was counted are initialized. The counters are initialized to count the number of line control signals used to print another recording medium.

Figure 5:
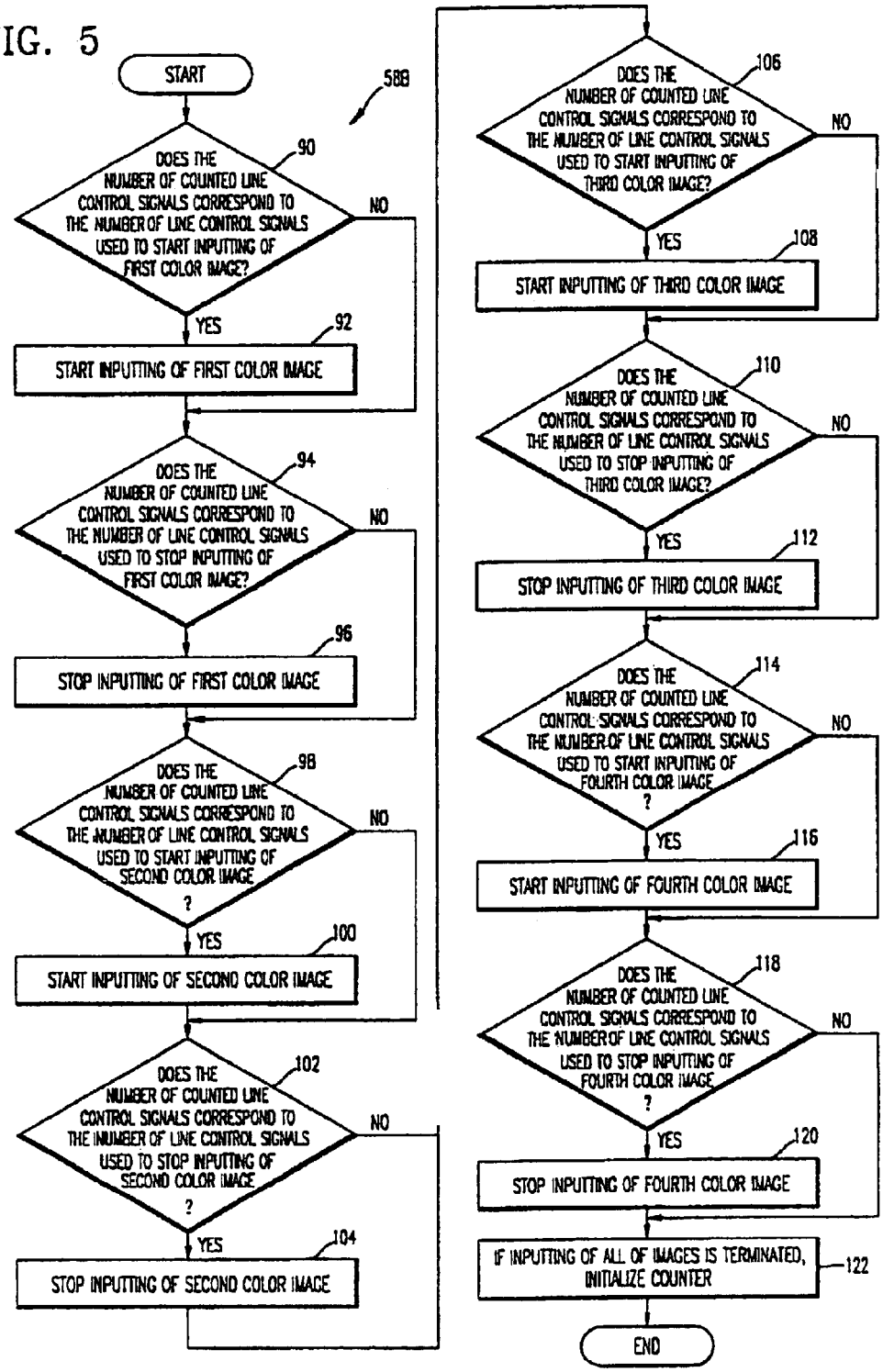
FIG. 5 is a flow chart to illustrate another embodiment of operation 58 shown in FIG. 3.

Embodiment 58B of operation 58 shown in FIG. 3, according to an aspect of the present invention, is shown in FIG. 5. The embodiment 58B comprises operations 90 through 122 of starting or stopping input of first through fourth color images required to form a desired color image, and initializing counted counters. When color images are printed, a four-time developing process of colors such as cyan (C), magenta (M), yellow (Y), and black (B) is performed to develop the color images. In this case, the first through fourth color images are input to repeat image input four times. Thus, when the number of printing colors is more than four, additional operations of starting and stopping input of color images are performed.

In operation 90, it is determined whether the number of counted line control signals corresponds to a number of line control signals used to start input of the first color image of fourth color images required to form a desired color image. If it is determined that the number of counted line control signals does not correspond to the number of line control signals used to start input of the first color image, the embodiment 58B proceeds to operation 94.

However, if it is determined that the number of counted line control signals corresponds to the number of line control signals used to start input of the first color image, in operation 92, input of the first color image starts.

After operation 92, in operation 94, it is determined that the number of counted line control signals corresponds to a number of line control signals used to stop input of the first color image. If it is determined that the number of counted line control signals does not correspond to the number of line control signals used to stop input of the first color image, the embodiment 58B proceeds to operation 98.

However, if it is determined that the number of counted line control signals corresponds to the number of line control signals used to stop input of the first color image, in operation 98, input of the first color image stops.

After operation 96, in operation 98, it is determined whether the number of counted line control signals corresponds to a number of line control signals used to start input of the second color image. If it is determined that the number of counted line control signals does not correspond to the number of line control signals used to start input of the second color image, the embodiment 58B proceeds to operation 102.

However, if it is determined that the number of counted line control signals corresponds to the number of line control signals used to start input of the second color image, in operation 100, input of the second color image starts.

After operation 100, in operation 102, it is determined whether the number of counted line control signals corresponds to a number of line control signals used to stop input of the second color image. If it is determined that the number of counted line control signals does not correspond to the number of line control signals used to stop input of the second color image, the embodiment 58B proceeds to operation 106.

However, if it is determined that the number of counted line control signals corresponds to the number of line control signals used to stop input of the second color image, in operation 104, input of the second color image stops.

After operation 104, in operation 106, it is determined whether the number of counted line control signals corresponds to a number of line control signals used to start input of the third color image. If it is determined that the number of counted line control signals does not correspond to the number of line control signals used to start input of the third color image, the embodiment 58B proceeds to operation 110.

However, if it is determined that the number of counted line control signals corresponds to the number of line control signals used to start input of the third color image, in operation 108, input of the third color image starts.

After operation 108, in operation 110, it is determined whether the number of counted line control signals corresponds to a number of line control signals used to stop input of the third color image. If it is determined that the number of counted line control signals does not correspond to the number of line control signals used to stop input of the third color image, the embodiment 58B proceeds to operation 114.

However, if it is determined that the number of counted line control signals corresponds to the number of line control signals use to stop input of the third color image, in operation 112, input of the third color image stops.

After operation 112, in operation 114, it is determined whether the number of counted line control signals corresponds to the number of line control signals used to start input of the fourth color image. If it is determined that the number of input counted line control signals does not correspond to the number of line control signals used to start input of the fourth color image, the embodiment 58B proceeds to operation 118.

However, if it is determined that the number of counted line control signals corresponds to a number of line control signals used to start input of the fourth color image, in operation 116, input of the fourth color image starts.

After operation 116, in operation 118, it is determined whether the number of counted line control signals corresponds to a number of line control signals used to stop input of the fourth color image. If it is determined that the number of counted line control signals does not correspond to the number of line control signals used to stop input of the fourth color image, the embodiment 58B proceeds to operation 122.

However, if it is determined that the number of counted line control signals corresponds to the number of line control signals use to stop input of the fourth color image, in operation 120, input of the fourth color image stops.

After operation 120, in operation 122, if input of all four images is terminated, the counted counters are initialized.

Figure 6:
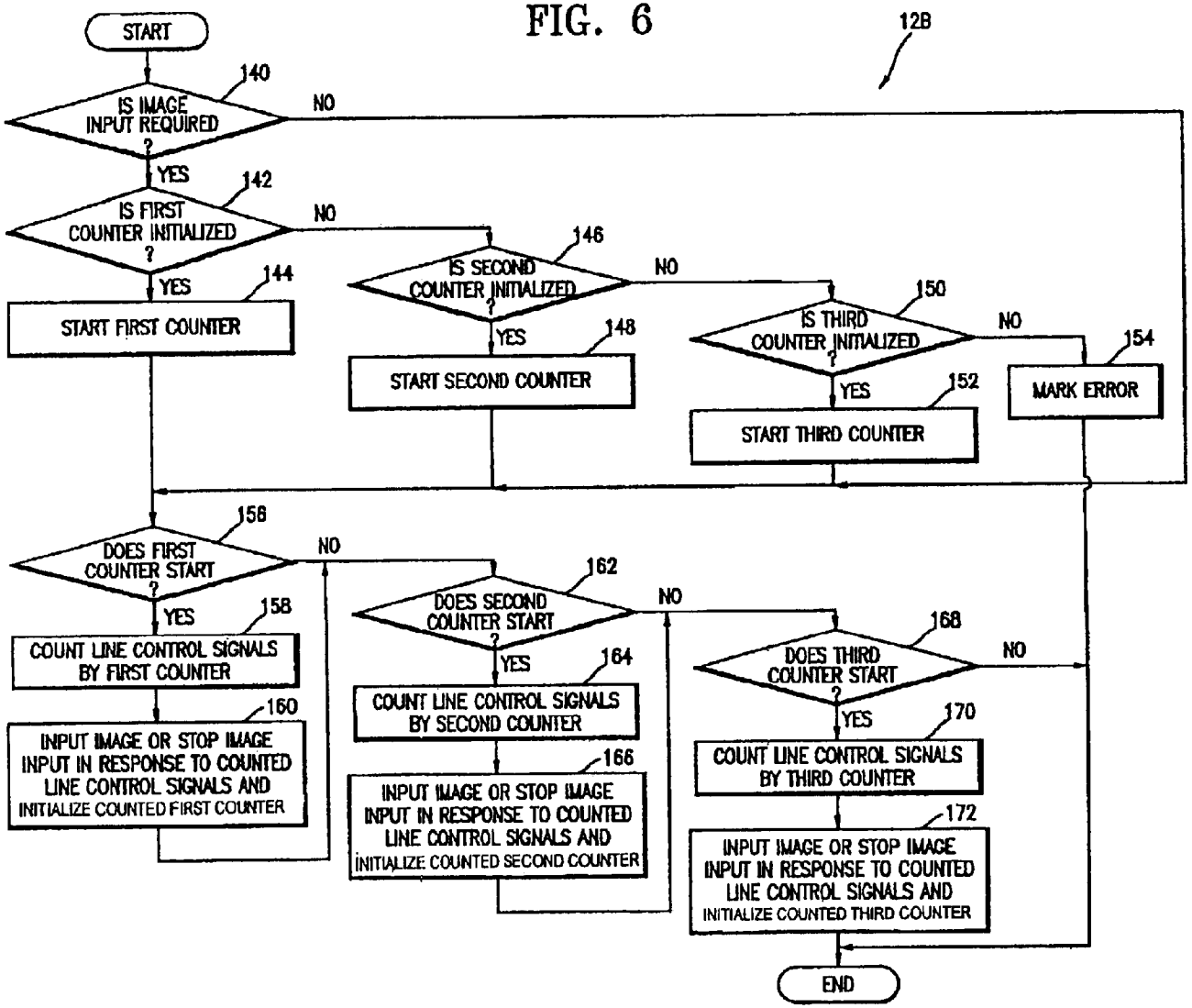
FIG. 6 is a flow chart to illustrate another embodiment of inputting an image into an exposure unit according to demands on synchronization of image input of operation 12 shown in FIG. 1.

Embodiment 12B of inputting an image into an exposure unit according to demands on synchronization of image input of operation 12 shown in FIG. 1 is shown in FIG. 6. The embodiment 12B comprises operations 140 through 172 of inputting an image or stopping image input by counting line control signals using three counters and initializing the above-mentioned counters. Although three counters are shown in FIG. 6, a plurality of counters, preferably more than m (m is a positive integer greater than 1) can be provided.

In operation 140, it is determined whether an image input is required. If the image input is not required, the embodiment 12B proceeds to operation 156.

However, if it is determined that the image input is required, in operation 142, it is determined whether a first counter is initialized. If it is determined that the first counter is not initialized, the embodiment 12B proceeds to operation 146.

However, if it is determined that the first counter is initialized, in operation 144, the first counter starts counting the line control signals.

If it is determined that the first counter is not initialized, in operation 146, it is determined whether a second counter is initialized. If it is determined that the second counter is initialized, in operation 148, the second counter starts counting the line control signals.

If it is determined that the second counter is not initialized, in operation 150, it is determined whether a third counter is initialized. If it is determined that the third counter is not initialized, the embodiment 12B proceeds to operation 154, and an error that the initialized counters are in short supply is marked.

However, if it is determined that the third counter is initialized, in operation 152, the third counter starts counting the line control signals.

After operations 144, 148, and 152, in operation 156, it is determined whether the first counter starts counting the line control signals. If it is determined that the first counter does not start counting the line control signals, the embodiment 12B proceeds to operation 162.

However, if it is determined that the first counter starts counting the line control signals, in operation 158, the number of line control signals is counted by the first counter.

After operation 158, in operation 160, an image is input or image input stops in response to the counted line control signals, and the counted first counter is initialized. Preferably, operation 160 comprises the same operations as those of the flow chart shown in FIG. 4 or FIG. 5 described previously.

If the first counter does not start counting the line control signals or after operation 160, in operation 162, it is determined whether the second counter starts counting the line control signals. If it is determined that the second counter does not start counting the line control signals, the embodiment 12B proceeds to operation 168.

However, if it is determined that the second counter starts counting the line control signals, in operation 164, the number of line control signals is counted by the second counter.

After operation 164, in operation 166, an image is input or image input stops in response to the counted line control signals, and the counted second counter is initialized. Preferably, the operation 166 comprises the same operations as those of the flow chart shown in FIG. 4 or FIG. 5 described previously.

If the second counter does not start counting the line control signals or after operation 166, in operation 168, it is determined whether the third counter starts counting the line control signals. If it is determined that the third counter does not start counting the line control signals, after the above-mentioned operations are terminated, the embodiment 12B repeats the above operations at a next execution point in time.

However, if it is determined that the third counter starts counting the line control signals, in operation 170, the number of line control signals is counted by the third counter.

After operation 170, in operation 172, an image is input or image input stops in response to the counted line control signals, and the counted third counter is initialized. Preferably, the operation 172 comprises the same operations as those of the flow chart shown in FIG. 4 or FIG. 5 described previously.

Figure 7:
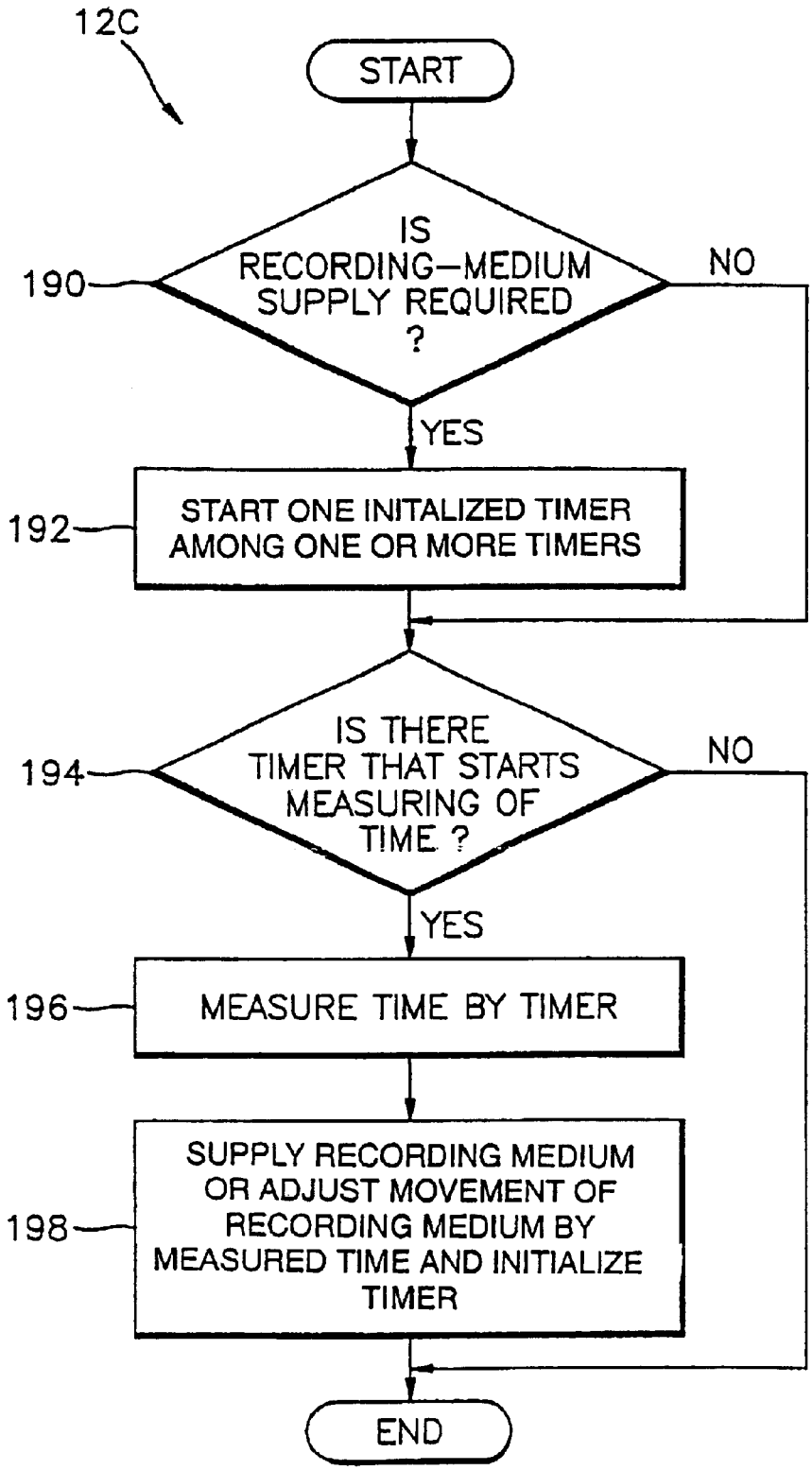
FIG. 7 is a flow chart to illustrate an embodiment of supplying a recording medium to a transfer unit according to demands on synchronization of image input of operation 12 shown in FIG. 12.
Figure 12:
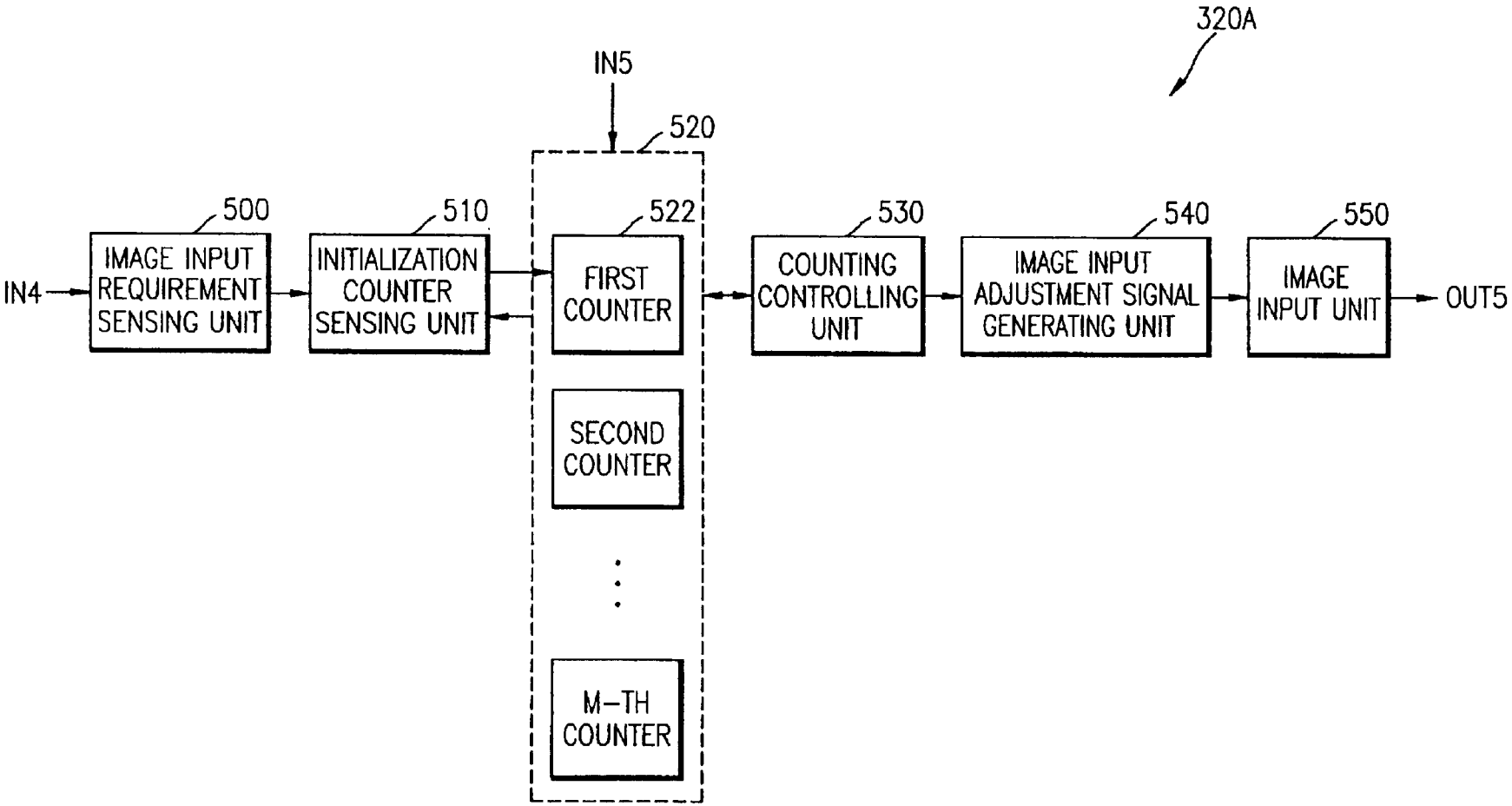
FIG. 12 is a block diagram to illustrate an image input processing unit shown in FIG. 10.

An embodiment 12C of supplying a recording medium to a transfer unit according to demands on synchronization of image input of operation 12 shown in FIG. 12 is illustrated in FIG. 7. The embodiment 12C comprises operations 190 through 198 of supplying a recording medium to a transfer unit and adjusting a position of the recording medium by measuring a time using initialized timers, if recording medium supply is required.

In operation 190, it is determined whether a recording-medium supply is required. If it is determined that the recording-medium supply is not required, the embodiment 12C proceeds to operation 194.

However, if it is determined that the recording-medium supply is required, in operation 192, at least one initialized timer starts.

After operation 192, in operation 194, it is determined whether there is a timer that starts operating to measure a time. If there is no timer that starts operating, after the above-mentioned operations are terminated, the embodiment 12C performs the above operations again at a next execution time.

However, if it is determined that there is a timer that starts operating, in operation 196, measuring of a time is performed by the timer.

After operation 196, in operation 198, the recording medium is supplied to the transfer unit or movement of the recording medium is adjusted by the measured time, and the timer is initialized.

Figure 8:
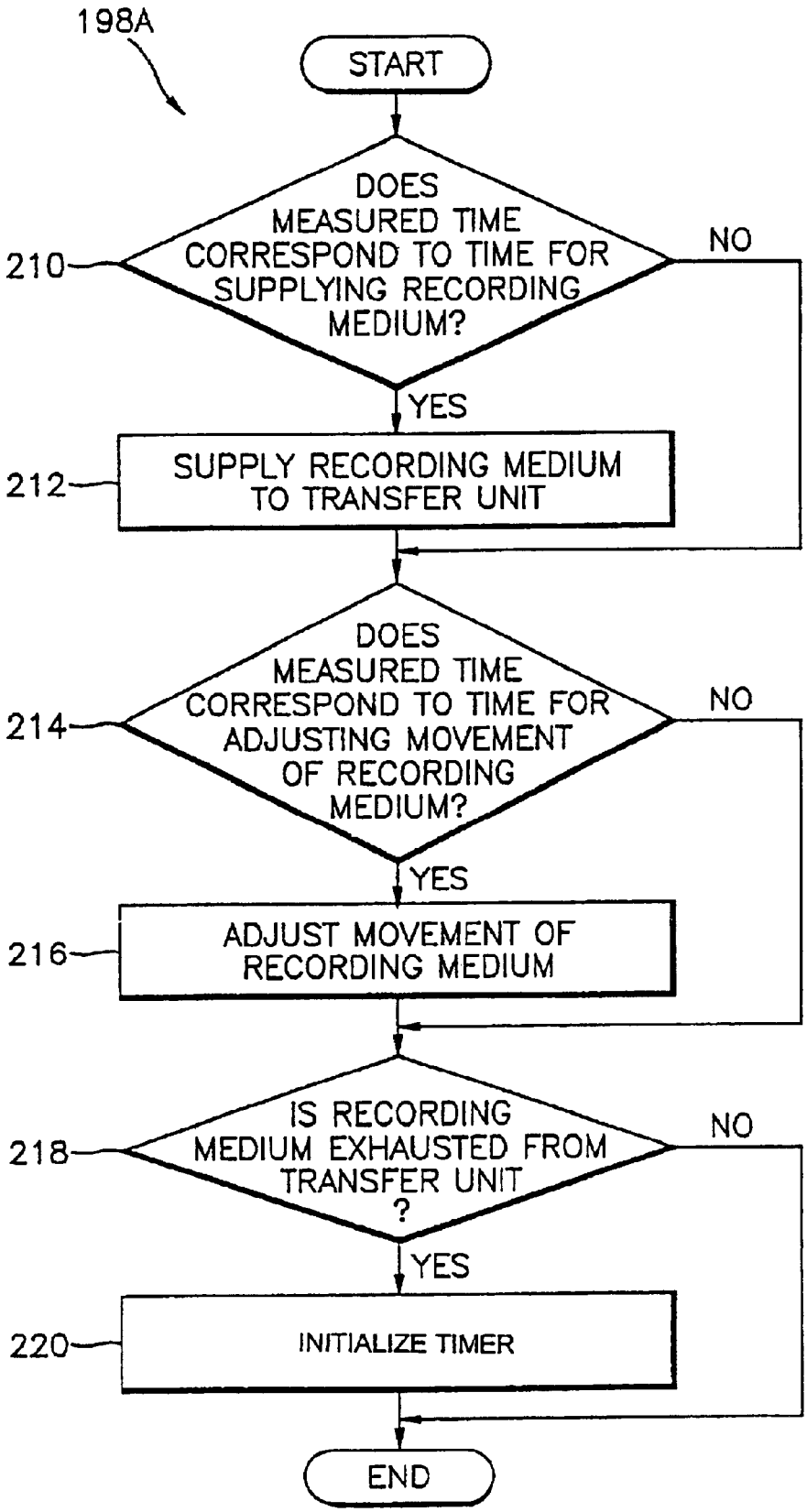
FIG. 8 is a flow chart to illustrate an embodiment of operation 198 shown in FIG. 7.

Embodiment 198A of operation 198 shown in FIG. 7 is illustrated in FIG. 8 according to an aspect of the present invention. The embodiment 198A comprises operations 210 through 220 of supplying a recording medium to a transfer unit, and adjusting a position of the recording medium by measuring a time using initialized timer and initializing the timer.

In operation 210, it is determined whether a time measured by the timer corresponds to a time needed to supply the recording medium to the transfer unit. The time needed to supply the recording medium to the transfer unit is defined as the time in which the recording medium is supplied from a paper feeding apparatus (not shown) to the transfer unit. The time needed to supply the recording medium to the transfer unit is preset before a printing operation starts. If it is determined that the measured time does not correspond to the time needed to supply the recording medium to the transfer unit, the embodiment 198A proceeds to operation 214.

However, if it is determined that the time measured by the timer corresponds to the time needed to supply the recording medium to the transfer unit, in operation 212, the recording medium is supplied to the transfer unit. That is, the recording medium is supplied from the paper feeding apparatus to the transfer unit.

After operation 212, in operation 214, it is determined whether the time measured by the timer corresponds to a time needed to adjust a movement of the recording medium. The time needed to adjust the movement of the recording medium is defined to make overlapping of a developed image on the recording medium supplied to the transfer unit coincident. The time to adjust the movement of the recording medium is preset before the printing operation starts. If it is determined that the measured time does not correspond to the time needed to adjust the movement of the recording medium, the embodiment 198A proceeds to operation 218.

However, if it is determined that the time measured by the timer corresponds to the time needed to adjust the movement of the recording medium, in operation 216, movement of the recording medium is adjusted. Movement of the recording medium is adjusted by changing a movement speed of the recording medium or stopping the movement of the recording medium and restarting it. As a result, the developed image is placed accurately in a proper position on the recording medium.

After operation 216, in operation 218, it is determined whether the recording medium is exhausted from the transfer unit for a predetermined amount of time. Preferably, it is also determined whether the recording medium is exhausted from the image forming apparatus for the predetermined amount of time. If it is determined that the recording medium is not exhausted from the transfer unit, the above-mentioned operations are terminated, and then, the embodiment 198A performs the above operations again at a next execution time.

However, if it is determined that the recording medium is exhausted from the transfer unit for the predetermined amount of time, in operation 220, the timer is initialized. The timer is initialized to measure a time required to print another recording medium. However, for a simple control, the method according to an aspect of the present invention may omit operation 218 and perform operation 220 after operation 216.

Figure 9:
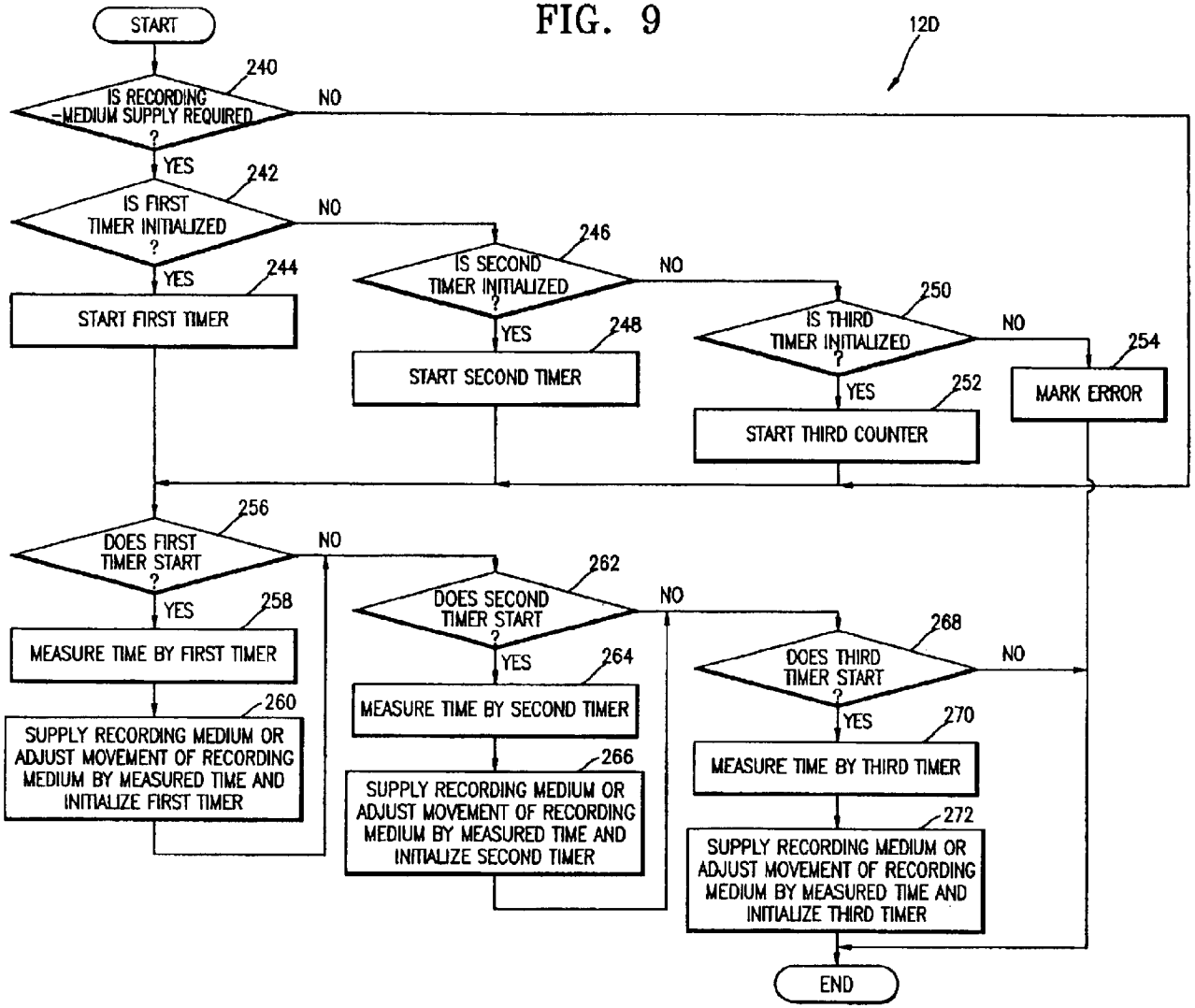
FIG. 9 is a flow chart to illustrate another embodiment of supplying a recording medium to a transfer unit according to demands on synchronization of image input of operation 12 shown in FIG. 12.

Another embodiment 12D of supplying a recoding medium to a transfer unit according to demands on synchronization of an image input of operation 12 shown in FIG. 12 is illustrated in FIG. 9. The embodiment 12D comprises operations 240 through 272 of supplying the recording medium to the transfer unit or stopping of recording-medium supply by measuring a time using three timers, and initializing the above-mentioned timers. Although three timers are shown in FIG. 9, a plurality of timers, preferably more than n (n is a positive integer greater than 1) can be provided.

In operation 240, it is determined whether a recording-medium supply is required. If it is determined that a recording-medium supply is not required, the embodiment 12D proceeds to operation 256.

However, if it is determined that a recording-medium supply is required, in operation 242, it is determined whether a first timer is initialized. If it is determined that the first timer is not initialized, the embodiment 12D proceeds to operation 246.

However, if it is determined that the first timer is initialized, in operation 244, the first timer starts operating.

If it is determined that the first timer is not initialized, in operation 246, it is determined whether a second timer is initialized. If it is determined that the second timer is not initialized, the embodiment 12D proceeds to operation 250.

However, if it is determined that the second timer is initialized, in operation 248, the second timer starts operating.

If it is determined that the second timer is not initialized, in operation 250, it is determined whether a third timer is initialized. If it is determined that the third timer is not initialized, the embodiment 12D proceeds to operation 254, and an error that initialized timers are in short supply, is marked, and the embodiment 12D is terminated. However, if it is determined that the third timer is initialized, in operation 252, the third timer starts operating.

After operations 244, 246, and 252, in operation 256, it is determined whether the first timer starts operating. If it is determined that the first timer does not start operating, the embodiment 12D proceeds to operation 262. However, if it is determined that the first timer starts operating, in operation 258, a time is measured by the first timer.

After operation 258, in operation 260, the recording medium is supplied to the transfer unit or movement of the recording medium is adjusted based on the measured time, and the first timer is initialized. Preferably, operation 260 comprises the same operations as those of the flow chart shown in FIG. 8 described previously.

If it is determined in operation 256 that the first timer does not start operating or after operation 260, in operation 262, it is determined whether the second timer starts operating. If it is determined that the second timer does not start operating, the embodiment 12D proceeds to operation 268. However, if it is determined that the second timer starts operating, in operation 264, a time is measured by the second timer.

After operation 264, in operation 266, the recording medium is supplied to the transfer unit or movement of the recording medium is adjusted based on the measured time, and the second timer is initialized. Preferably, operation 266 comprises the same operations as those of the flow chart shown in FIG. 8 described previously.

If it is determined in operation 262 that the second timer does not start operating or after operation 266, in operation 268, it is determined whether the third timer starts operating. If it is determined that the third timer does not start operating, the above-mentioned operations are terminated, and then, the embodiment 12D performs the above operations again at a next execution time.

However, if it is determined that the third timer starts operating, in operation 270, a time is measured by the third timer.

After operation 270, in operation 272, the recording medium is supplied to the transfer unit, or movement of the recording medium is adjusted based on the measured time, and the third timer is initialized. Preferably, operation 272 comprises the same operations as those of the flow chart shown in FIG. 8 described previously.

Hereinafter, the structure and operation of an apparatus to control an image input and a recording-medium supply of an image forming apparatus, according to an aspect of the present invention, in which the method to control image input and a recording-medium supply of an image forming apparatus according to one aspect of the present invention is implemented will be described with reference to the accompanying drawings.

Figure 10:
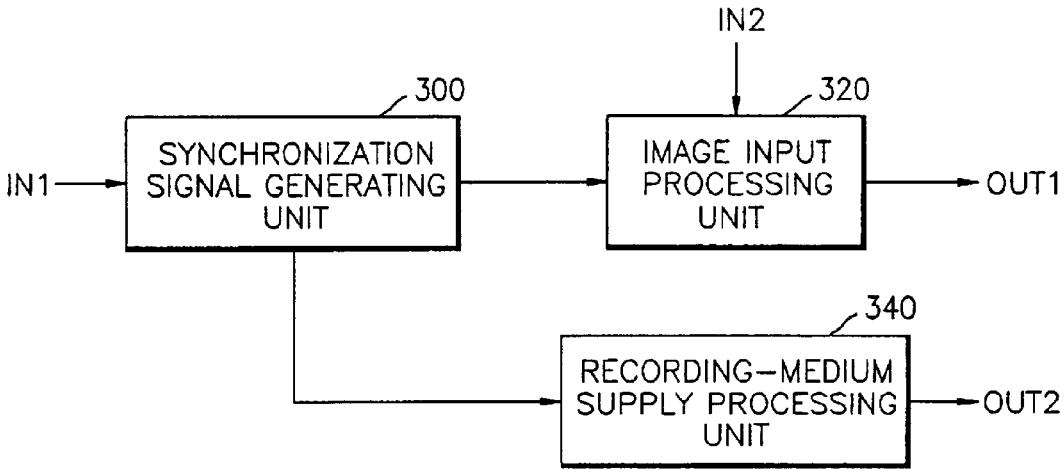
FIG. 10 is a block diagram to illustrate an apparatus to control an image input and a recording-medium supply of an image forming apparatus in which the method to control an image input and a recording-medium supply of an image forming apparatus shown in FIG. 1 is implemented.

An apparatus to control an image input and a recording-medium supply of an image forming apparatus according to one aspect of the present invention is shown in FIG. 10. The apparatus comprises the method to control an image input and a recording-medium supply of an image forming apparatus shown in FIG. 1, according to one aspect of the present invention. The apparatus includes a synchronization signal generating unit 300, an image input processing unit 320, and a recording-medium supply processing unit 340.

In order to perform operation 10, the synchronization signal generating unit 300 shown in FIG. 10 generates each synchronization demand signal to input an image into an exposure unit and to periodically supply a recording medium to a transfer unit, and outputs each generated synchronization demand signal. For example, the synchronization signal generating unit 300 receives a printing required signal through an input terminal IN1, generates each synchronization demand signal to input the image into the exposure unit and to periodically supply the recording medium to the transfer unit, outputs the generated synchronization demand signals to input the image into the image input processing unit 320, and outputs the generated synchronization demand signals to supply the recording medium to the recording-medium supply processing unit 340.

Figure 11:
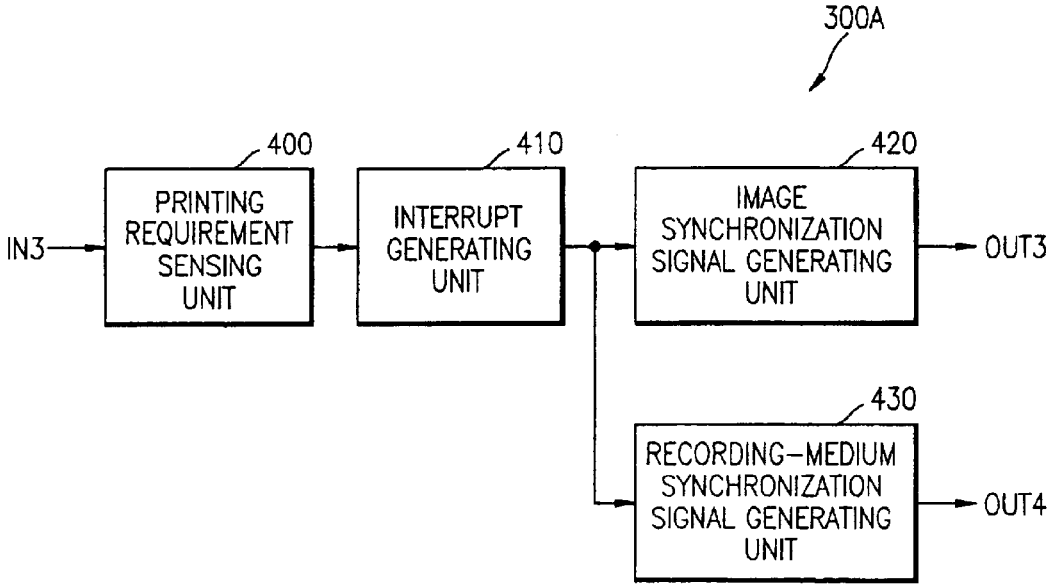
FIG. 11 is a block diagram to illustrate a synchronization signal generating unit shown in FIG. 10.

Embodiment 300A of a synchronization signal generating unit 300 shown in FIG. 10, according to an aspect of the present invention, is illustrated in FIG. 11. The embodiment 300A comprises a printing requirement sensing unit 400, an interrupt generating unit 410, an image synchronizing signal generating unit 420, and a recording-medium synchronization signal generating unit 430.

In order to perform operation 30, the printing requirement sensing unit 400 senses whether a printing operation is required, and outputs the result of sensing. For example, the printing requirement sensing unit 400 receives a printing required signal through an input terminal IN3 and outputs the result of sensing to the interrupt generating unit 410.

In order to perform operation 32, the interrupt generating unit 410 periodically generates an interrupt in response to the result of sensing, and outputs the generated interrupt. An interrupt generation period may be arbitrarily generated for each predetermined amount of time or may be coincident with a rotation period of a developing unit (not shown) in which the input image is changed into a toner image, or a rotation period of a transfer unit (not shown) in which the toner image is transferred on the supplied recording medium. For example, the interrupt generating unit 410 periodically generates an interrupt in response to the result of sensing to detect whether or not a printing required signal is transmitted from the printing requirement sensing unit 400 and outputs the periodically-generated interrupt to the image synchronization signal generating unit 420 and the recording-medium synchronization signal generating unit 430, respectively. In this case, the interrupt generating unit 410 outputs a signal requiring sensing of printing requirement again to the printing requirement sensing unit 400.

In order to perform operation 34, the image synchronization signal generating unit 420 generates the synchronization demand signal for image input in response to the generated interrupt, and outputs the generated synchronization demand signal. For example, the image synchronization signal generation unit 420 generates an image input synchronization demand signal periodically in response to the interrupt transmitted from the interrupt generating unit 410 and outputs the periodically-generated image input synchronization demand signal to the image input processing unit 320 through an output terminal OUT3.

Also, in order to perform operation 34, the recording-medium synchronization signal generating unit 430 generates a synchronization demand signal for recording-medium supply in response to the generated interrupt, and outputs the generated synchronization demand signal. For example, the recording-medium synchronization signal generating unit 430 periodically generates a recording-medium supply synchronization demand signal in response to the interrupt transmitted from the interrupt generating unit 410 and outputs the periodically-generated recording-medium supply synchronization demand signal to the recording medium supply processing unit 340 through an output terminal OUT4.

Meanwhile, in order to perform operation 12, the image input processing unit 320 inputs an image into an exposure unit (not shown) in response to a synchronization demand signal for image input. For example, the image input processing unit 320, which receives line control signals from the exposure unit through an input terminal IN2, generates a signal used to start or stop image input in response to the synchronization demand signal for image input transmitted from the synchronization signal generating unit 300 and outputs the generated signal through an output terminal OUT1.

An embodiment 320A of an image input processing unit 320 shown in FIG. 10, according to one aspect of the present invention, is illustrated in FIG. 12. The embodiment 320A comprises an image-input requirement sensing unit 500, an initialization counter sensing unit 510, a counting unit 520, a counting controlling unit 530, an image-input adjustment signal generating unit 540, and an image input unit 550.

In order to perform operation 50, the image-input requirement sensing unit 500 senses whether image input is required, and outputs the result of sensing. For example, the image-input requirement sensing unit 500 receives a synchronization demand signal for image input through an input terminal IN4, and outputs the result of sensing to the initialization counter sensing unit 510.

In order to perform operation 52, the initialization counter sensing unit 510 senses whether there is an initialized counter among the counters provided in the counting unit 520, and transmits the synchronization demand signal for image input. For example, the initialization counter sensing unit 510 senses a first counter 522 that is initialized among first through m-th counters (m is a positive integer greater than 1) provided in the counting unit 520 in response to the synchronization demand signal for image input received from the image-input requirement sensing unit 500, and transmits the synchronization demand signal for input of an image into the initialized first counter 522. The first counter 522 may be set to '1' in response to the synchronization demand signal transmitted by the initialization counter sensing unit 510.

In order to perform operation 56, the first through m-th counters are provided in the counting unit 520, and the counters count the number of line control signals. For example, because the first counter 522 of the counting unit 520 having a plurality of counters is set to "1" in response to the synchronization demand signal for image input transmitted from the initialization counter sensing unit 510, the first counter 522 counts the number of line control signals input through an input terminal IN5.

In order to perform operation 58, the counting controlling unit 530 senses whether the number of counted line control signals corresponds to the number of line control signals used to start image input, outputs the first result of sensing, senses whether the number of counted line control signals corresponds to the number of line control signals used to stop image input, outputs the second result of sensing, and initializes the counter which has counted the number of line control signals in response to the second result of sensing. For example, the counting controlling unit 530 senses whether the number of line control signals counted by the first counter 522 corresponds to the number of line control signals used to start image input, outputs the first result of sensing to the image input adjustment signal generating unit 540, senses whether the number of line control signals counted by the first counter 522 corresponds to the number of line control signals used to stop image input, and outputs the second result of sensing to the image input adjustment signal generating unit 540. Also, the counting controlling unit 530 initializes the first counter 522 in response to the second result of sensing.

The image input adjustment signal generating unit 540 generates an image-input start signal in response to the above-mentioned first result of sensing, generates an image input stop signal in response to the above-mentioned second result of sensing, and outputs the generated image-input start signal and the image input stop signal. For example, the image input adjustment signal generating unit 540 generates the image-input start signal and the image-input stop signal in response to the first result and the second result sensed by the counting controlling unit 530, and outputs the generated image-input start signal and the generated image-input stop signal to the image input unit 550.

The image input unit 550 starts and stops input of an image into the exposure unit in response to the generated image-input start signal and the image-input stop signal. For example, the image input unit 550 starts or stops input of an image into the exposure unit through an output terminal OUT5 in response to the image-input start signal and the image-input stop signal received from the image input adjustment signal generating unit 540.

Meanwhile, in order to perform operation 12, the recording-medium supply processing unit 340 supplies the recording medium to the transfer unit in response to synchronization demand signal for recording-medium supply. For example, the recording-medium supply processing unit 340 generates a signal to supply the recording medium to the transfer unit in response to the synchronization demand signal for recording-medium supply transmitted from the synchronization signal generating unit 300, and outputs the generated signal through an output terminal OUT2.

Figure 13:
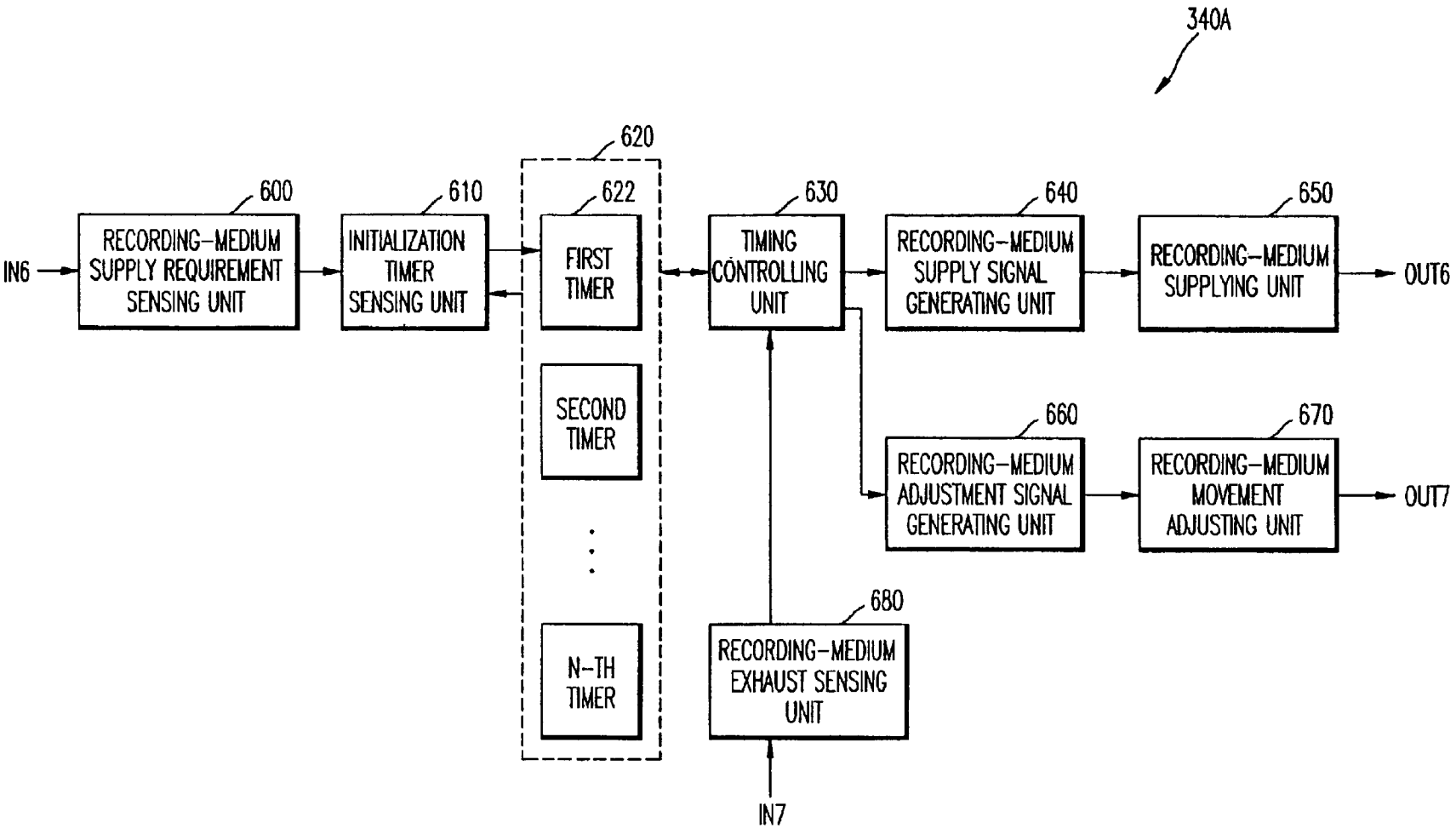
FIG. 13 is a block diagram to illustrate a recording-medium supplying unit shown in FIG. 10.

An embodiment 340A of a recording-medium supplying unit 340 shown in FIG. 10, according to an aspect of the present invention, is illustrated in FIG. 13. The embodiment 340A includes a recording-medium supply requirement sensing unit 600, an initialization timer sensing unit 610, a timing unit 620, a timing controlling unit 630, a recording-medium supply signal generating unit 640, a recording-medium supplying unit 650, a recording-medium adjustment signal generating unit 660, a recording-medium movement adjusting unit 670, and a recording-medium exhaust sensing unit 680.

In order to perform operation 190, the recording-medium supply requirement sensing unit 600 senses whether recording-medium supply is required, and outputs the result of the sensing. For example, the recording-medium supply sensing unit 600 receives a synchronization demand signal for recording-medium supply through an input terminal IN6, and outputs the result of sensing to the initialization timer sensing unit 610.

In order to perform operation 192, the initialization timer sensing unit 610 senses whether there is an initialized timer among the timers provided in the timing unit 620, and transmits the synchronization demand signal for recording-medium supply to the initialized timer. For example, the initialization counter sensing unit 610 senses a first timer 622 initialized among first through n-th timers (n is a positive integer greater than 1) provided in the timing unit 620 in response to the synchronization demand signal for recording-medium supply received from the recording-medium supply requirement sensing unit 600, and transmits the synchronization demand signal for supplying of a recording medium to the initialized first timer 622. The first timer 622 may be set to '1' in response to the synchronization demand signal transmitted by the initialization timer sensing unit 610.

In order to perform operation 196, the first through n-th timers are provided in the timing unit 620, and the timing unit 620 measures a time from the timers in response to the transmitted synchronization demand signal for recording-medium supply.

In order to perform 198, the timing controlling unit 630 senses whether the measured time corresponds to a timer for supplying a recording medium to a transfer unit, outputs the third result of sensing, senses whether the measured time corresponds to a time to adjust movement of the recording medium, outputs the fourth result of sensing, and initializes a timer by which the time is measured in response to the signal transmitted from the recording-medium exhaust sensing unit 680. For example, as described previously, when the first timer 622 starts measuring a time, the timing controlling unit 630 senses whether the time measured by the first timer 622 corresponds to the time needed to supply the recording medium to the transfer unit, and outputs the third result of sensing to the recording-medium supply signal generating unit 640. Also, the timing controlling unit 630 senses whether the time measured by the first timer 622 corresponds to the time needed to adjust movement of the recording medium, and outputs the fourth result of sensing to the recording-medium movement adjustment signal generating unit 660. Also, the timing controlling unit 630 initializes the first timer 622 in response to the signal transmitted from the recording-medium exhaust sensing unit 680.

The recording-medium supply signal generating unit 640 generates a recording-medium supply signal in response to the third result sensed by the timing controlling unit 630, and outputs the generated recording-medium supply signal. For example, the recording-medium supply signal generating unit 640 generates the recording-medium supply signal in response to the third result of sensing and outputs the generated recording-medium supply signal to the recording-medium supplying unit 650.

The recording-medium supplying unit 650 feeds the recording medium from a recording-medium supplying apparatus, and supplies the recording medium to a transfer unit in response to the transmitted recording-medium supply signal. That is, the recording-medium supplying unit 650 feeds the recording medium from the recording-medium supplying apparatus through an output terminal OUT6, and supplies the recording medium to the transfer unit in response to the recording-medium supply signal transmitted from the recording-medium supply signal generating unit 630.

The recording-medium adjustment signal generating unit 660 generates a recording-medium movement adjustment signal in response to the fourth result sensed via the timing controlling unit 630, and outputs the generated recording-medium movement adjustment signal. For example, the recording-medium adjustment signal generating unit 660 generates the recording-medium movement adjustment signal in response to the fourth result of sensing, and outputs the generated recording-medium movement adjustment signal to the recording-medium movement adjusting unit 670.

The recording-medium movement adjusting unit 670 adjusts movement of the recording medium to the transfer unit in response to the generated recording-medium movement adjustment signal. The recording-medium movement adjusting unit 670 makes the position of a toner image coincident with a front end of the recording medium before the toner image is transferred on the recording medium to compensate a difference caused by recording-medium supply performed by the recording-medium supplying unit 650 during a color image printing operation. For example, the recording-medium movement adjusting unit 670 varies the speed of the recording medium in the transfer unit through an output terminal OUT7 or stops and starts supplying the recording medium in response to the recording-medium movement adjustment signal transmitted from the recording-medium adjustment signal generating unit 660 so the position of the toner image is coincident with the front end of the recording medium.

The recording-medium exhaust sensing unit 680 senses whether the recording medium is exhausted from the transfer unit, and outputs the result of the exhaust sensing to the timing controlling unit 630. For example, the recording-medium exhaust sensing unit 680 receives a signal which indicates whether the recording medium finishes the printing operation through an input terminal IN7 and is exhausted from the transfer unit, senses the signal, and outputs the result of the exhaust sensing to the timing controlling unit 630. As a result, the timing controlling unit 630 initializes a timer by which time is measured, in response to the result of exhaust sensing transmitted from the recording-medium exhaust sensing unit 680.

Figure 14:
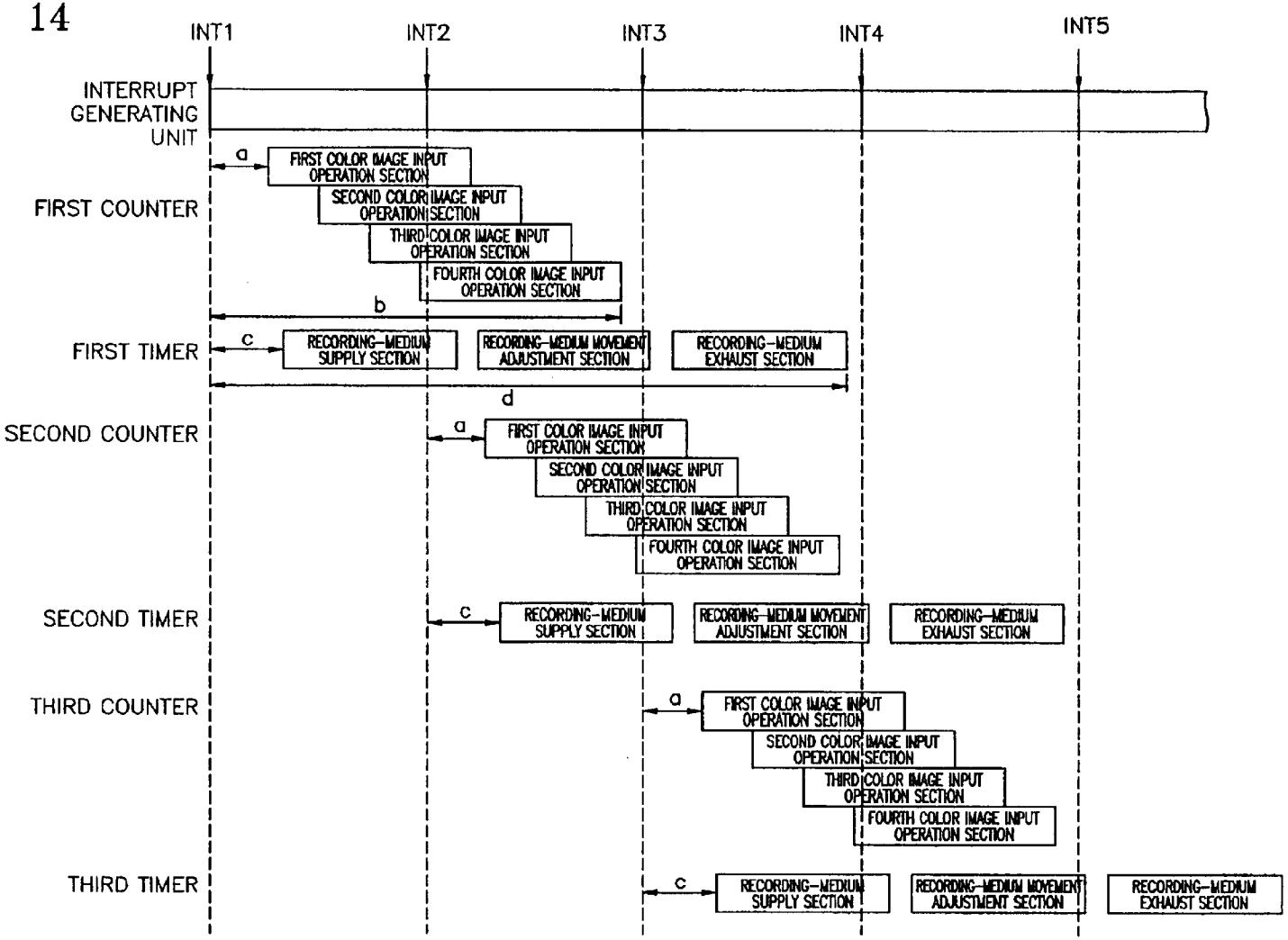
FIG. 14 is a timing chart to illustrate an embodiment of operations performed in an interrupt generating unit shown in FIG. 11, a counting unit shown in FIG. 12, and a timing unit shown in FIG. 13.

An embodiment of operations performed in an interrupt generating unit 410 shown in FIG. 11, a counting unit 520 shown in FIG. 12, and a timing unit 620 shown in FIG. 13, according to an aspect of the present invention, is illustrated in FIG. 14.

Referring to FIG. 14, a first interrupt INT1, a second interrupt INT2, a third interrupt INT3, a fourth interrupt INT4, and a fifth interrupt INT5 are generated by the interrupt generating unit 410 at a predetermined period.

The counting unit 520 includes a first counter, a second counter, and a third counter. Each counter performs a first color image input operation, a second color image input operation, a third color image input operation, and a fourth color image input operation to print a color image.

The timing unit 620 includes a first timer, a second timer, and a third timer. Each timer performs a recoding-medium supply operation, a recording-medium movement adjustment operation, and a recording-medium exhaustion operation.

If the first interrupt INT1 is generated, a printing operation is performed on a first page of an image to be printed, and if the second interrupt INT2 is generated, a printing operation is performed on a second page of the image to be printed. After that, whenever an interrupt is generated, the above-mentioned printing operations are performed.

If the first interrupt INT1 is generated, the first counter and the first timer start operations, and if the second interrupt INT2 is generated, the second counter and the second timer start operations, and if the third interrupt INT3 is generated, the third counter and the third timer start operations. In this case, a section a is a time which corresponds to the number of line control signals preset to start the above-mentioned image input, and a section c corresponds to a time preset to supply the above-mentioned recording medium. Since the sections a and c are maintained at a regular time interval whenever an interrupt is generated, image input and recording-medium supply of an image forming apparatus can be easily performed.

The number of first through m-th counters provided in the counting unit 520 is more than a number obtained, when one-time interrupt is generated, by adding 1 (the above-mentioned one-time interrupt) to the number of interrupts generated from a time when one counter starts counting to a time when the counter is initialized. For example, as shown in FIG. 12, if the first interrupt is generated, the first counter starts counting, and after the second interrupt is generated, the first counter stops counting and is initialized. That is, since the first counter is initialized only if a time which corresponds to a section b has passed, 2, which is a number obtained by adding 1 (first interrupt INT1) to the one-time interrupt INT2 occurring in the section b, is the minimum number of counters to be provided in the counting unit 520. The reason for this is to prevent lack of initialized counters required to print a next page when less than two counters are provided in the counting unit 520.

The number of first through n-th timers provided in the timing unit 620 is more than a number obtained, when one-time interrupt is generated, by adding 1 (the above-mentioned one-time interrupt) to the number of interrupts generated from a time when one timer starts measuring of a time to a time when the timer is initialized. For example, as shown in FIG. 12, if the first interrupt is generated, the first counter starts measuring of a time, and after the third interrupt is generated, the first counter stops measuring of a time and is initialized. That is, since the first timer is initialized only if a time which corresponds to a section d has passed, 3, which is a number obtained by adding 1 (first interrupt INT1) to the two-time interrupts INT2 and INT3 occurring in the section d, is the minimum number of counters to be provided in the timing unit 620. The reason for this is to prevent lack of initialized timers required to print a next page when less than two timers are provided in the timing unit 620.

Accordingly, the method and apparatus to control image input and recording-medium supply of an image forming apparatus allow demands on image input and recording-medium supply per page to be synchronized such that an image can be printed in a correct position on a recording medium even under simple control. Moreover, the method and apparatus improve reliability of image printing control, and the image forming apparatus can be easily designed.

Although a few embodiments of the present invention have been shown and described it would be appreciated by those skilled in the art that changes may be made in these embodiments without departing from the spirit and scope of the invention as defined by the appended claims and their equivalents.

What is claimed is:

1. A method to control an image input and a recording-medium supply of an image forming apparatus, comprising:

periodically generating synchronized demands of the image input into an exposure unit, and periodically generating synchronized demand for the recording medium supply to a transfer unit;

inputting the image into the exposure unit according to the synchronized demand of the image input;

supplying the recording medium to the transfer unit according to the synchronized demand for the recording-medium supply;

forming an electrostatic latent image via the exposure unit in response to an input image signal;

changing the electrostatic latent image into a toner image via a developing unit; and transferring the toner image to a recording medium to which the toner image is supplied via the transfer unit.

2. The method as claimed in claim 1, wherein when periodically generating synchronized demand of the image input and demand for the recording medium supply, a generation period of the synchronized demand of the image input and demand for the recording-medium supply is made coincident with a rotation period of the developing unit or a rotation period of the transfer unit.

3. The method as claimed in claim 1, wherein the operation of periodically generating synchronized demand of the image input and demand for the recording medium supply, further comprises:

determining whether a printing operation is required;

upon determining that the printing operation is required, determining whether an interrupt is generated; and upon determining that the interrupt is generated, generating the synchronized demand of the image input and demand for the recording-medium supply.

4. The method as claimed in claim 1, wherein the operation of inputting the image into the exposure unit according to the synchronized demand of the input image, further comprises:

determining whether the image input is required;

upon determining that the image input is required, starting an initialized counter to count the number of line control signals output from the exposure unit;

determining whether there is a counter that starts counting the line control signals;

upon determining that there is the counter that starts counting the line control signals, counting the line control signals via the counter;

inputting the image or stopping the image input according to the number of counted line control signals; and initializing the counter.

5. The method as claimed in claim 4, wherein the operation of inputting the image or stopping the image input according to the number of counted line control signals, further comprises:

determining whether the number of line control signals counted by the counter corresponds to a number of line control signals used to start the image input;

upon determining that the number of line control signals counted by the counter corresponds to the number of line control signals used to start the image input, starting the image input;

determining whether the number of line control signals counted by the counter corresponds to a number of line control signals used to stop the image input;

upon determining that the number of line control signals counted by the counter corresponds to the number of line control signals used to stop the image input, stopping the image input; and initializing the counter via which the number of line control signals is counted.

6. The method as claimed in claim 5, wherein the number of line control signals used to start and stop the image input is preset before the printing operation is performed.

7. The method as claimed in claim 4, wherein the operation of inputting the image or stopping the image input according to the number of counted line control signals, further comprises:

determining whether the number of counted line control signals corresponds to a number of line control signals used to start input of a first color image among first through fourth color images required to form a color image;

upon determining that the number of counted line control signals corresponds to the number of line control signals used to start input of the first color image, starting input of the first color image;

determining whether the number of counted line control signals corresponds to a number of line control signals used to stop input of the first color image;

upon determining that the number of counted line control signals corresponds to the number of line control signals used to stop input of the first color image, stopping input of the first color image;

determining whether the number of counted line control signals corresponds to a number of line control signals used to start input of a second color image;

upon determining that the number of counted line control signals corresponds to the number of line control signals used to start input of the second color image, stating input of the second color image;

determining whether the number of counted line control signals corresponds to a number of line control signals used to stop input of the second color image;

upon determining that the number of counted line control signals corresponds to the number of line control signals used to stop input of the second color image, stopping input of the second color image;

determining whether the number of counted line control signals corresponds to a number of line control signals used to start input of a third color image;

upon determining that the number of counted line control signals corresponds to the number of line control signals used to start input of the third color image, stating input of the third color image;

determining whether the number of counted line control signals corresponds to a number of line control signals used to stop input of the third color image;

upon determining that the number of counted line control signals corresponds to the number of line control signals used to stop input of the third color image, stopping input of the third color image;

determining whether the number of counted line control signals corresponds to a number of line control signals used to start input of a fourth color image;

upon determining that the number of counted line control signals corresponds to the number of line control signals used to start input of the fourth color image, starting input of the fourth color image;

determining whether the number of counted line control signals corresponds to a number of line control signals used to stop input of the fourth color image;

upon determining that the number of counted line control signals corresponds to the number of line control signals used to stop input of the fourth color image, stopping input of the fourth color image; and initializing the counter via which the number of line control signals is counted.

8. The method as claimed in claim 7, wherein the operation of starting and stopping of the color image input is repeated as many times as a number of colors of the color image.

9. The method as claimed in claim 7, wherein the number of line control signals used to start and stop the image input is preset before the printing operation is performed.

10. The method as claimed in claim 4, further comprising:

starting the image input upon determination that the number of line control signals counted via the counter corresponds to a number of line control signals used to start the image input;

stopping an image input upon determination that the number of line control signals counted via the counter corresponds to a number of line control signals used to stop the image input; and initializing the counter via which the number of line control signals are counted.

11. The method as claimed in claim 4, wherein the line control signals output from the exposure unit are line synchronizing signals or horizontal synchronizing signals.

12. The method as claimed in claim 4, wherein the counting of the line control signals starts when the line control signals are generated.

13. The method as claimed in claim 1, wherein the operation of inputting the image into the exposure unit according to the synchronized demand of the input image, further comprises:

determining whether the image input is required;

upon determining that the image input is required, determining whether a first counter among first through m counters is initialized, where m is a positive integer greater than 1;

upon determining that the first counter is initialized, starting the first counter;

upon determining that the first counter is not initialized, sequentially determining whether one or more of the counters are initialized and starting the initialized counters;

upon determining that the m-th counter is not initialized, marking an error that initialized counters are in short supply and terminating the above steps;

determining whether the first counter starts operating upon determining that the first counter is initialized;

upon determining that the first counter starts operating, counting the line control signals via the first counter;

inputting the image or stopping the image input in response to the counted line control signals and initializing the counted first counter;

upon determining that the first counter does not start operating, sequentially determining whether one or more counters start operating, and counting the line control signals by one or more of the counters; and inputting the image or stopping the image input according to the number of line control signals counted by one or more of the counters and initializing one or more of the counters via which the number of line control signals are counted.

14. The method as claimed in claim 13, wherein the operation of inputting the image or stopping the image input in response to the counted line control signals and initializing the counted first counter, further comprises:

determining whether the number of line control signals counted by the first counter corresponds to a number of line control signals used to start the image input;

upon determining that the number of line control signals counted by the first counter corresponds to the number of line control signals used to start the image input, starting the image input;

determining whether the number of line control signals counted by the first counter corresponds to a number of line control signals used to stop the image input;

upon determining that the number of line control signals counted by the first counter corresponds to the number of line control signals used to stop the image input, stopping the image input; and initializing the first counter which has counted the number of line control signals.

15. The method as claimed in claim 13, wherein the operation of inputting the image or stopping the image input according to the number of line control signals counted by one or more of the counters and initializing of one or more of the counters via which the number of line control signals are counted, further comprises:

determining whether the number of line control signals counted by one or more counters among the second through m-th counters corresponds to the number of line control signals used to start the image input;

upon determining that the number of line control signals counted by one or more counters among the second through m-th counters corresponds to the number of line control signals used to start the image input, starting the image input;

determining whether the number of line control signals counted by one or more counters among the second through m-th counters corresponds to the number of line control signals used to stop the image input;

upon determining that the number of line control signals counted by one or more counters among the second through m-th counters corresponds to the number of line control signals used to stop the image input, stopping the image input; and initializing one or more counters which have counted the number of line control signals among the second through m-th counters.

16. The method as claimed in claim 13, wherein the operation of inputting the image or stopping the image input in response to the counted line control signals and initializing the counted first counter, further comprises:

determining whether the number of line control signals counted by the first counter corresponds to a number of line control signals used to start input of a first color image of four color images required to form a color image;

upon determining that the number of line control signals counted by the first counter corresponds to the number of line control signals used to start input of the first color image, starting input of the first color image;

determining whether the number of line control signals counted by the first counter corresponds to a number of line control signals used to stop input of the first color image;

upon determining that the number of line control signals counted by the first counter corresponds to the number of line control signals used to stop input of the first color image, stopping input of the first color image;

determining whether the number of line control signals counted by the first counter corresponds to a number of line control signals used to start input of a second color image;

upon determining that the number of line control signals counted by the first counter corresponds to the number of line control signals used to start input of the second color image, starting input of the second color image;

determining whether the number of line control signals counted by the first counter corresponds to a number of line control signals used to stop input of the second color image;

upon determining that the number of line control signals counted by the first counter corresponds to a number of line control signals used to stop input of the second color image, stopping input of the second color image;

determining whether the number of line control signals counted by the first counter corresponds to a number of line control signals used to start input of a third color image;

upon determining that the number of line control signals counted by the first counter corresponds to the number of line control signals used to start input of the third color image, starting input of the third color image;

determining whether the number of line control signals counted by the first counter corresponds to a number of line control signals used to stop input of the third color image;

upon determining that the number of line control signals counted by the first counter corresponds to a number of line control signals used to stop input of the third color image, stopping input of the third color image;

determining whether the number of line control signals counted by the first counter corresponds to a number of line control signals used to start input of a fourth color image;

upon determining that the number of line control signals counted by the first counter corresponds to the number of line control signals used to start input of a fourth color image, starting input of the fourth color image;

determining whether the number of line control signals counted by the first counter corresponds to a number of line control signals used to stop input of the fourth color image;

upon determining that the number of line control signals counted by the first counter corresponds to a number of line control signals used to stop input of the fourth color image, stopping input of the fourth color image; and initializing the first counter which has counted the number of line control signals.

17. The method as claimed in claim 16, wherein the number of line control signals used to start and stop input of color images required to form a color image is preset before the printing operation is performed.

18. The method as claimed in claim 13, wherein the operation of inputting the image or stopping the image input according to the number of line control signals counted by one or more of the counters and initializing of one or more of the counters via which the number of line control signals are counted, further comprises:

determining whether the number of line control signals counted by one or more counters among the second through m-th counters corresponds to a number of line control signals used to start input of first through fourth color images required to form a color image;

upon determining that the number of line control signals counted by one or more counters among the second through m-th counters corresponds to the number of line control signals used to start input of the first color image, starting input of the first color image;

determining whether the number of line control signals counted by one or more counters among the second through m-th counters corresponds to a number of line control signals used to stop input of the first color image;

upon determining that the number of line control signals counted by one or more counters among the second through m-th counters corresponds to the number of line control signals used to stop input of the first color image, stopping input of the first color image;

determining whether the number of line control signals counted by one or more counters among the second through m-th counters corresponds to a number of line control signals used to start input of the second color image;

upon determining that the number of line control signals counted by one or more counters among the second through m-th counters corresponds to the number of line control signals used to start input of the second color image, starting input of the second color image;

determining whether the number of line control signals counted by one or more counters among the second through m-th counters corresponds to a number of line control signals used to stop input of the second color image;

upon determining that the number of line control signals counted by one or more counters among the second through m-th counters corresponds to the number of line control signals used to stop input of the second color image, stopping input of the second color image;

determining whether the number of line control signals counted by one or more counters among the second through m-th counters corresponds to a number of line control signals used to start input of the third color image;

upon determining that the number of line control signals counted by one or more counters among the second through m-th counters corresponds to the number of line control signals used to start input of the third color image, starting input of the third color image;

determining whether the number of line control signals counted by one or more counters among the second through m-th counters corresponds to a number of line control signals used to stop input of the third color image;

upon determining that the number of line control signals counted by one or more counters among the second through m-th counters corresponds to the number of line control signals used to stop input of the third color image, stopping input of the third color image;

determining whether the number of line control signals counted by one or more counters among the second through m-th counters corresponds to a number of line control signals used to start input of the fourth color image;

upon determining that the number of line control signals counted by one or more counters among the second through m-th counters corresponds to the number of line control signals used to start input of the fourth color image, starting input of the fourth color image;

determining whether the number of line control signals counted by one or more counters among the second through m-th counters corresponds to a number of line control signals used to stop input of the fourth color image;

upon determining that the number of line control signals counted by one or more counters among the second through m-th counters corresponds to the number of line control signals used to stop input of the fourth color image, stopping input of the fourth color image; and initializing one or more counters which have counted the number of line control signals among the second through m-th counters.

19. The method as claimed in claim 18, wherein the number of line control signals used to start and stop input of color images required to form a color image is preset before the printing operation is performed.

20. The method as claimed in claim 1, wherein the operation of inputting the image into the exposure unit according to the synchronized demand of the image input, further comprises:

determining whether recording-medium supply is required;

upon determining that recording-medium supply is required, starting at least one initialized timer to measure a time required to control movement of a recording medium;

determining whether there at least one timer that starts measuring of the time;

upon determining that there is at least one timer that starts measuring of the time, measuring the time by the timer;

supplying the recording medium to the transfer unit or adjusting movement of the recording medium according to the measured time; and initializing the timer via which the time is measured.

21. The method as claimed in claim 20, wherein the operation of supplying the recoding medium to the transfer unit or adjusting movement of the recording medium according to the measured time, further comprises:

determining whether a time measured by the timer corresponds to a time needed to supply the recording medium to the transfer unit;

upon determining that the time measured by the timer corresponds to the time needed to supply the recording medium, the recording medium is supplied to the transfer unit;

determining whether the recording medium is exhausted from the transfer unit; and upon determining that the recording medium is exhausted from the transfer unit, initializing the timer.

22. The method as claimed in claim 21, wherein upon determining whether the recording medium is exhausted from the transfer unit, it is determined whether the recording medium is exhausted from an image forming apparatus.

23. The method as claimed in claim 21, wherein the operation of supplying the recoding medium to the transfer unit or adjusting movement of the recording medium according to the measured time, further comprises:

upon determining that the time measured by the timer corresponds to the time needed to supply the recording medium;

determining whether the time measured by the timer corresponds to a time needed to adjust movement of the recording medium;

upon determining that the time measured by the timer corresponds to the time to adjust movement of the recording medium, adjusting movement of the recording medium; and initializing the timer subsequent to a determination that the recording medium has been exhausted.

24. The method as claimed in claim 21, wherein the timer is initialized subsequent to a determination that the recording medium is exhausted from the transfer unit for a predetermined amount of time.

25. The method as claimed in claim 21, wherein the time needed to supply the recording medium to the transfer unit is predetermined.

26. The method as claimed in claim 20, further comprising:

adjusting movement of the recording medium upon determination that the measured time corresponds to a time needed to adjust the movement of the recording medium; and the timer is initialized subsequent to a determination that the recording medium is exhausted from the transfer unit for a predetermined amount of time.

27. The method as claimed in claim 1, wherein the operation of inputting the image into the exposure unit according to the synchronized demand of the image input, further comprises:

determining whether the recording-medium supply is required;

upon determining that the recording-medium supply is required, determining whether a first timer of n timers is initialized, where n is a positive integer greater than 1;

upon determining that the first timer is initialized, starting the first timer;

upon determining that the first timer is not initialized, sequentially determining whether one or more of the n timers is initialized, and starting the initialized timers;

upon determining that none of the n timers are initialized, marking an error that the initialized timers are in short supply, and terminating the above steps;

upon determining that a timer is initialized, determining whether the first timer starts operating;

upon determining that the first timer starts operating, measuring a time by the first timer;

supplying the recording medium to the transfer unit or adjusting movement of the recording medium according to the measured time, and initializing the starting first timer;

upon determining that the first timer does not start or after sequentially determining at least one of the n timers start operating, measuring the time by starting one or more of the timers; and supplying the recording medium to the transfer unit or adjusting a movement of the recording medium according to the time measured by one or more of the timers, and initializing one or more of the timers which have measured the time.

28. The method as claimed in claim 27, wherein upon supplying the recording medium to the transfer unit or adjusting movement of the recording medium according to the measured time, and initializing the starting first timer, further comprises:

determining whether the time measured by the first timer corresponds to a time needed to supply the recording medium to the transfer unit;

upon determining that the time measured by the fist timer corresponds to the time needed to supply the recording medium to the transfer unit, supplying the recording medium to the transfer unit;

determining whether the recording medium is exhausted from the transfer unit; and upon determining that the recording medium is exhausted from the transfer unit, initializing the first timer.

29. The method as claimed in claim 28, wherein upon supplying the recording medium to the transfer unit or adjusting movement of the recording medium according to the measured time, further comprises:

determining whether the time measured by the first timer corresponds to a time needed to adjust movement of the recording medium;

upon determining that the time measured by the first timer corresponds to the time needed to adjust movement of the recording medium, adjusting movement of the recording medium;

determining whether the recording medium is exhausted from the transfer unit; and upon determining that the recording medium is exhausted from the transfer unit, initializing the first timer.

30. The method as claimed in claim 27, wherein the supplying the recording medium to the transfer unit or adjusting a movement of the recording medium according to the time measured by one or more of the timers, further comprises:

determining whether the time measured by one or more of the n timers corresponds to a time needed to supply the recording medium to the transfer unit;

upon determining that the time measured by one or more of the n timers corresponds to the time needed to supply the recording medium to the transfer unit, supplying the recording medium to the transfer unit;

determining whether the recording medium is exhausted from the transfer unit; and upon determining that the recording medium is exhausted from the transfer unit, initializing one or more of the n timers which have measured the time.

31. The method as claimed in claim 30, wherein supplying the recording medium to the transfer unit or adjusting a movement of the recording medium according to the time measured by one or more of the timers, further comprises:

determining whether the time measured by one or more of the n timers corresponds to a time needed to adjust movement of the recording medium; and upon determining that the time measured by one or more of the n timers corresponds to the needed to adjust movement of the recording medium, adjusting movement of the recording medium.

32. The method as claimed in claim 31, wherein one or more of the n timers which have measured the time are initialized upon determination that the recording medium is exhausted from the transfer unit.

33. The method as claimed in claim 1, further comprising:

determining whether an interrupt is generated upon determination that a printing operation is required; and generating the synchronized demand of the image input and demand for the recording-medium supply upon determination that the interrupt is generated.

34. The method as claimed in claim 1, further comprising:

starting an initialized counter to count the number of line control signals output from the exposure unit upon determination that the input image is required, wherein counting of the line control signals is started upon finding a counter that has started counting the line control signals;

inputting an image or stopping an image input according to the number of counted line control signals; and initializing the counter.

35. The method as claimed in claim 34, further comprising:

starting input of a first color image upon determination that the number of counted line control signals corresponds to the number of line control signals used to start input of the first color image;

stopping input of the first color image upon determination that the number of counted line control signals corresponds to the number of line control signals used to stop input of the first color image;

stating input of a second color image upon determination that the number of the counted line control signals corresponds to the number of line control signals used to start input of the second color image;

stopping input of the second color image upon determination that the number of counted line control signals corresponds to the number of line control signals used to stop input of the second color image;

stating input of a third color image upon determination that the number of counted line control signals corresponds to the number of line control signals used to start input of a third color image;

stopping input of the third color image upon determination that the number of counted line control signals corresponds to the number of line control signals used to stop input of the third color image;

starting input of a fourth color image upon determination that the number of counted line control signals corresponds to the number of line control signals used to start input of a fourth color image;

stopping input of the fourth color image upon determination that the number of counted line control signals corresponds to the number of line control signals used to stop input of the fourth color image; and initializing the counter after input of the images is complete.

36. The method as claimed in claim 1, further comprising:

determining whether at least one of m counters are initialized upon determination that an image input is required, where m is a positive integer greater than 1;

starting at least one of the initialized counters;

determining if none of the counters are initialized, marking an error that initialized counters are in short supply if none of the counters are initialized and terminating the determination of whether the at least one m counter is initialized;

counting the line control signals via the initialized counter that has started operating; and inputting an image or stopping an image input in response to the counted line control signals and initializing the counter that performed the counting.

37. The method as claimed in claim 36, further comprising:

starting an image input upon determination that the number of counted line control signals via at least one counter corresponds to a number of line control signals used to start image input;

stopping an image input upon determination that the number of counted line control signals via at least one counter corresponds to a number of line control signals used to stop image input; and initializing the one or more counters which have counted the number of line control signals.

38. The method as claimed in claim 1, further comprising:

starting at least one initialized timer to measure a time required to control movement of a recording medium after determining that the recording-medium supply is required;

measuring a time by the timer;

supplying the recording medium to the transfer unit or adjusting movement of the recording medium according to the measured time; and initializing the timer via which the time is measured.

39. The method as claimed in claim 38, wherein:

the recording medium is supplied to the transfer unit upon determination that the measured time corresponds to a time needed to supply the recording medium to the transfer unit; and the timer is initialized subsequent to a determination that the recording medium is exhausted from the transfer unit.

40. The method as claimed in claim 1, wherein the synchronized demand of the image input and the demand for the recording medium supply are generated at the same time.

41. The method as claimed in claim 1, wherein the synchronized demand of the image input and the demand for the recording medium supply are arbitrarily set.

42. An apparatus to control an image input and a recording-medium supply of an image forming apparatus, comprising:

a synchronization signal generating unit, to periodically generate synchronization demand signal to input the image into the exposure unit and to supply the recording medium to the transfer unit, and to output generated synchronization demand signal;

an image input processing unit to input the image into the exposure unit in response to the synchronization demand signal of the image input;

a recording-medium supply processing unit to supply the recording medium to the transfer unit in response to the synchronization demand signal for the recording-medium supply, an exposure unit to form an electrostatic latent image in response to an input image signal;

a developing unit to change the electrostatic latent image into a toner image; and a transfer unit to transfer the toner image on a recording medium to which the toner image is supplied.

43. The apparatus as claimed in claim 42, wherein the synchronization signal generating unit further comprises:

a printing requirement sensing unit which senses whether a printing operation is required, and outputs the result of sensing;

an interrupt generating unit which periodically generates an interrupt in response to the result of sensing and outputs the generated interrupt;

an image synchronization signal generating unit which generates a synchronization demand signal of the image input in response to the generated interrupt and outputs the generated synchronization demand signal; and a recording-medium synchronization signal generating unit which generates a synchronization demand signal of the recording-medium supply in response to the generated interrupt and outputs the generated synchronization demand signal.

44. The apparatus as claimed in claim 43, wherein the interrupt generating unit generates an interrupt with a rotation period of the developing unit or a rotation period of the transfer unit.

45. The apparatus as claimed in claim 43, wherein the printing requirement sensing unit receives a printing required signal through and input terminal and outputs the result of the sensing to the interrupt generating unit.

46. The apparatus as claimed in claim 43, wherein the interrupt generating unit generates an interrupt arbitrarily for each predetermined amount of time.

47. The apparatus as claimed in claim 42, wherein the image input processing unit further comprises:

first through m-th where m is a positive integer greater than 1, counters which count the number of line control signals output from the exposure unit and output the result of counting;

an image-input requirement sensing unit which senses whether image input is required, and outputs the result of sensing;

an initialization counter sensing unit which senses whether there is an initialized counter among the first through m-th counters in response to the result of sensing, and transmits the synchronization demand signal of the image input into the initialized counter;

a counting controlling unit which senses whether the number of line control signals counted by the first through m-th counters corresponds to a number of line control signals used to start image input, outputs the first result of sensing, senses whether the number of counted line control signals corresponds to the number of line control signals used to stop image input, outputs the second result of sensing, and initializes the counter which has counted the number of line control signals in response to the second result of sensing;

an image input adjustment signal generating unit which generates an image-input start signal in response to the first result of sensing, generates an image input stop signal in response to the second result of sensing, and outputs the generated image-input start signal and the image input stop signal; and an image input unit which starts and stops input of the image into the exposure unit in response to the transmitted image-input start signal and the transmitted image-input stop signal, respectively.

48. The apparatus as claimed in claim 47, wherein m is more than a number obtained when one-time interrupt is generated by adding 1 to the number of interrupts generated from a time when one counter among the m counters starts counting a time when the counter is initialized.

49. The apparatus as claimed in claim 42, wherein the recording-medium supply processing unit further comprises:

first through n-th where n is a positive integer greater than 1 timers which measure a time;

a recoding-medium supply requirement sensing unit which senses whether recording-medium supply is required, and outputs the result of sensing;

an initialization timer sensing unit which senses whether there is an initialized timer among the first through n-th counters in response to the result of sensing, and transmits the synchronization demand signal for recording-medium supply to the initialized timer;

a timing controlling unit which senses whether the time measured by the first through n-th timers corresponds to a timer needed to supply a recording medium to a transfer unit, outputs the third result of sensing, senses whether the time measured by the fist through n-th timers corresponds to a time needed to adjust movement of the recording medium, and outputs the fourth result of sensing;

a recording-medium supply signal generating unit which generates a recording-medium supply signal in response to the third result of sensing, and outputs the generated recording-medium supply signal;

a recording-medium supplying unit which supplies the recording medium to the transfer unit in response to the generated recording-medium supply signal; and a recording-medium exhaust sensing unit which senses whether the recording medium is exhausted from the transfer unit, and outputs the result of exhaust sensing;

wherein the timer which has measured the time, is initialized in response to the result of exhaust sensing.

50. The apparatus as claimed in claim 49, wherein the recording-medium supply processing unit further comprises:

a recording-medium adjustment signal generating unit which generates recording-medium movement adjustment signal in response to the fourth result sensed by the timing controlling unit and outputs the generated recoding-medium movement adjustment signal; and a recording-medium movement adjusting unit which adjusts movement of the recording medium to the transfer unit in response to the transmitted recording-medium adjustment signal.

51. The apparatus as claimed in claim 49, wherein n is more than a number obtained when one-time interrupt is generated by adding 1 to the number of interrupts generated from a time when one timer among the first through n-th timers starts measuring of a time to a time when the timer is initialized.

52. A method to control an image input and a recording medium supply of an image forming apparatus, comprising:

periodically generating a timer interrupt when a printing operation is requested;

synchronizing a demand of an image input and a demand for a recording medium supply via the generated timer interrupt;

inputting the image according to the synchronized demand of the image input; and supplying the recording medium according to the synchronized demand for the recording medium supply.

53. The method as claimed in claim 52, wherein the synchronized demand of the image input and the demand for the recording supply are simultaneously generated whenever the interrupt is generated.

54. The method as claimed in claim 52, wherein the synchronized demand of the image input and the demand for the recording medium supply are generated at the same time.

55. The method as claimed in claim 52, wherein the synchronized demand of the image input and the demand for the recording medium supply are arbitrarily set.

56. An apparatus to control an image input and a recording medium supply of an image forming apparatus, comprising:

a timer interrupt unit to periodically generate an interrupt when a printing operation is requested;

a synchronization unit to synchronize a demand of an image input and a demand for a recording medium supply via the generated timer interrupt;

an image input unit to input the image according to synchronized demand of the image input; and a supply unit to supply a recording medium according to the synchronized demand for the image input and the demand for the recording medium supply.

* * * * *

UNITED STATES PATENT AND TRADEMARK OFFICE

CERTIFICATE OF CORRECTION

PATENT NO. : 6,907,222 B2
DATED : June 14, 2005
INVENTOR(S) : Beom-ro Lee

It is certified that error appears in the above-identified patent and that said Letters Patent is hereby corrected as shown below:

Column 25,
Line 49, change "fist" to -- first --.

Signed and Sealed this

Twenty-first Day of March, 2006

JON W. DUDAS
*Director of the United States Patent and Trademark Office*